US010739689B2

(12) United States Patent
Anno et al.

(10) Patent No.: US 10,739,689 B2
(45) Date of Patent: Aug. 11, 2020

(54) ELECTROSTATIC CHARGE IMAGE DEVELOPER AND PROCESS CARTRIDGE

(71) Applicant: FUJI XEROX CO., LTD., Tokyo (JP)

(72) Inventors: Shintaro Anno, Kanagawa (JP); Yosuke Tsurumi, Kanagawa (JP); Takuro Watanabe, Kanagawa (JP); Fusako Kiyono, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/262,946

(22) Filed: Jan. 31, 2019

(65) Prior Publication Data

US 2020/0096888 A1 Mar. 26, 2020

(30) Foreign Application Priority Data

Sep. 20, 2018 (JP) ..... 2018-176285

(51) Int. Cl.

| | |
|---|---|
| ***G03G 9/08*** | (2006.01) |
| ***G03G 9/083*** | (2006.01) |
| ***G03G 9/087*** | (2006.01) |
| ***G03G 9/09*** | (2006.01) |

(52) U.S. Cl.

CPC ..... *G03G 9/0804* (2013.01); *G03G 9/0808* (2013.01); *G03G 9/0839* (2013.01); *G03G 9/08797* (2013.01); *G03G 9/09* (2013.01)

(58) Field of Classification Search

CPC ..... G03G 9/0804; G03G 9/09; G03G 9/0839; G03G 9/0808; G03G 9/08797

See application file for complete search history.

(56) References Cited

U.S. PATENT DOCUMENTS

| | | | | |
|---|---|---|---|---|
| 5,672,455 | A * | 9/1997 | Yanagida | G03G 9/1133 430/111.1 |
| 9,811,019 | B2 * | 11/2017 | Kamae | G03G 9/1075 |
| 2003/0180643 | A1 * | 9/2003 | Suzuki | G03G 9/08782 430/108.6 |
| 2007/0281233 | A1 * | 12/2007 | Pickering | G03G 9/08704 430/108.3 |
| 2009/0202935 | A1 * | 8/2009 | Moriya | G03G 9/0804 430/109.4 |
| 2012/0225379 | A1 * | 9/2012 | Mine | G03G 9/1133 430/109.3 |
| 2015/0177630 | A1 | 6/2015 | Umeda et al. | |
| 2017/0329247 | A1 * | 11/2017 | Murasawa | G03G 9/113 |
| 2018/0246432 | A1 * | 8/2018 | Nishikawa | G03G 9/08797 |
| 2018/0267416 | A1 * | 9/2018 | Uchino | G03G 9/0825 |

FOREIGN PATENT DOCUMENTS

| | | |
|---|---|---|
| JP | 2014202965 | 10/2014 |
| JP | 2015079166 | 4/2015 |
| JP | 2015125272 | 7/2015 |
| JP | 2015135486 | 7/2015 |

* cited by examiner

*Primary Examiner* — Thorl Chea
(74) *Attorney, Agent, or Firm* — JCIPRNET

(57) ABSTRACT

An electrostatic charge image developer contains a carrier including a core and, on the core, a silicone resin-containing layer serving as a lower layer, and an acrylic resin-containing layer serving as an upper layer, or a carrier including a silicone resin-containing core and an acrylic resin-containing layer on the silicone resin-containing core; strontium titanate particles having an average primary particle size of 20 nm or more and 100 nm or less; and a toner. The percentage of a silicone resin exposed on a surface of the carrier is 0.5 area % or more and 20 area % or less.

16 Claims, 2 Drawing Sheets

ELECTROSTATIC CHARGE IMAGE DEVELOPER AND PROCESS CARTRIDGE

CROSS-REFERENCE TO RELATED APPLICATIONS

This application is based on and claims priority under 35 USC 119 from Japanese Patent Application No. 2018-176285 filed Sep. 20, 2018.

BACKGROUND

(i) Technical Field

The present disclosure relates to an electrostatic charge image developer and a process cartridge.

(ii) Related Art

Electrophotography is one of methods for visualizing image information through electrostatic charge images and currently used in various fields.

In the related art, electrophotography typically involves visualizing image information through a plurality of steps including forming an electrostatic latent image on a photoreceptor or an electrostatic recording medium by using various techniques, developing the electrostatic latent image (toner image) by attaching toner or electroscopic particles in an electrostatic charge image developer to the electrostatic latent image, transferring the developed image onto the surface of a transfer receptor, and fixing the image through heating or the like.

Japanese Unexamined Patent Application Publication No. 2015-79166 discloses a method for producing toner. The method includes a melt-kneading step of melt-kneading a toner composition containing a binder resin and a coloring agent to form a melt-kneaded product, a grinding step of solidifying the melt-kneaded product by cooling and grinding the cooled solidified product to form a ground product, a classifying step of classifying the ground product to form toner particles, a mixing step of adding inorganic fine particles A to the toner particles and mixing these particles to form a mixture, a heating step of heating the mixture to form heated toner particles, and an externally adding step of adding inorganic fine particles B to the heated toner particles and mixing these particles to form toner. In this method, the circularity of particles having an equivalent circle diameter of 1.98 μm or more and 200.00 μm or less is measured by using a flow-type particle image measuring apparatus with an imaging resolution of 512×512 pixels (0.37 μm×0.37 μm per pixel). The average circularity A determined from the particle proportion in each of 800 divided circularity ranges from circularity 0.200 to 1.000 is 0.945 or more and 0.960 or less. The toner particles have a weight-average particle size (D4) of 4.0 μm or more and 9.0 μm or less. In the toner particles, the amount of particles having a particle size of 4.0 μm or less is 40% by number or less, and the amount of particles having a particle size of 10.1 μm or more is 5% by volume or less. The inorganic fine particles A are silica fine particles whose primary particles have a number-average particle size (D1) of 0.06 μm or more and 0.20 μm or less. The average circularity B of the heated toner particles and the average circularity A of the toner particles are in the range represented by the following formula.

Formula: $0.005 \leq (\text{average circularity } B - \text{average circularity } A) \leq 0.020$ Japanese Unexamined Patent Application Publication No. 2015-125272 discloses a method for producing toner. The method includes an externally adding step of placing a particle mixture in a container of a mixing apparatus and processing the particle mixture, where the particle mixture includes toner particles, first inorganic fine particles, and second inorganic fine particles. The liberation ratio of the first inorganic fine particles to the toner particles is 2% or more and 40% or less. The liberation ratio of the second inorganic fine particles to the toner particles is 70% or more and 95% or less. The amount of the first inorganic fine particles is 0.1 mass % or more and 3.0 mass % or less. The amount of the second inorganic fine particles is 0.1 mass % or more and 2.0 mass % or less. When the number-average particle size (D1) of the primary particles of the first inorganic fine particles is represented by L1 [nm], and the number-average particle size (D1) of the primary particles of the second inorganic fine particles is represented by L2 [nm], L1 and L2 satisfy $2.5 \leq L1/L2 \leq 50$ and $5 \leq L2 \leq 50$. The mixing apparatus includes a stirring member that has a rotary shaft and stirring blades on the surface of the rotary shaft, a container that contains the stirring member and has a cylindrical inner surface, and a drive unit that applies rotation driving force to the rotary shaft to rotate the stirring member in the container. The stirring blades are spaced apart from the inner surface of the container. The stirring blades include a first stirring blade that forces the particle mixture, which has been placed in the container, in one of the axial directions of the rotary shaft as the stirring member rotates, and a second stirring blade that forces the particle mixture in another axial direction of the rotary shaft.

Japanese Unexamined Patent Application Publication No. 2015-135486 discloses a method for producing toner. The method includes a first mixing step of mixing inorganic fine particles and toner base particles containing a coloring agent, a crystalline resin, an amorphous resin, and a wax to form a mixture, and a second mixing step of further mixing the mixture. The first mixing step and the second mixing step use a mixer having, in a container, a stirring unit that applies a mechanical impact force. When the processing temperature in the first mixing step is represented by $T_1$ (° C.), the stirring power of the mixer per unit mass of the material being processed in the first mixing step is represented by $W_1$ (W/kg), the processing temperature in the second mixing step is represented by $T_2$ (° C.), and the stirring power of the mixer per unit mass of the material being processed in the second mixing step is represented by $W_2$ (W/kg), the following formulas (1), (2), (3), and (4) are satisfied:

$$TgA \leq T_1 < Tp \quad (1)$$

$$TgA \leq T_2 < Tp \quad (2)$$

$$3 < W_2 \quad (3)$$

$$W_2 \leq 1/2W_1 \quad (4)$$

wherein Tp (° C.) represents the onset temperature of the maximum endothermic peak from the crystalline resin in the toner base particles, which are used as a test sample, in temperature rising from 20° C. to 180° C. at a heating rate of 10° C./min in differential scanning calorimetry (DSC), and TgA (° C.) represents the glass transition temperature of the toner base particles, which are used as a test sample, in second temperature rising from 20° C. to 180° C. at a heating rate of 10° C./min just after cooling to 20° C. at a cooling rate of 50° C./min after temperature rising from 20° C. to 180° C. at a heating rate of 10° C./min in differential scanning calorimetry (DSC).

Japanese Unexamined Patent Application Publication No. 2014-202965 discloses a method for mixing raw materials including a binder resin and a coloring agent for toner by using a mixer. The mixer includes a processing chamber that contains the raw materials, and a rotary body that is disposed in the processing chamber and rotatable about a driving shaft. The rotary body includes (i) a rotary body main part and (ii) a processing part that includes an end portion projecting beyond the circumferential rotation path of the rotary body main part and that processes the raw materials. The processing part has a processing surface that hits the materials being processed and processes the materials as the rotary body rotates. The processing surface has a first region adjacent to the rotary body main part and a second region adjacent to the end portion and located downstream of the first region in the rotation direction of the rotary body.

SUMMARY

Aspects of non-limiting embodiments of the present disclosure relate to an electrostatic charge image developer containing a carrier including a core and, on the core, a silicone resin-containing layer serving as a lower layer, and an acrylic resin-containing layer serving as an upper layer, or a carrier including a silicone resin-containing core and an acrylic resin-containing layer on the silicone resin-containing core. The electrostatic charge image developer may reduce occurrence of density unevenness in the initial printing stage after being left to stand in a high-temperature, high-humidity environment (28° C., 90% RH) compared with an electrostatic charge image developer obtained in the case where strontium titanate particles have an average primary particle size of less than 20 nm or more than 100 nm, or the percentage of the silicone resin exposed on the surface of the carrier is less than 0.5 area % or more than 20 area %.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided an electrostatic charge image developer containing a carrier including a core and, on the core, a silicone resin-containing layer serving as a lower layer, and an acrylic resin-containing layer serving as an upper layer, or a carrier including a silicone resin-containing core and an acrylic resin-containing layer on the silicone resin-containing core; strontium titanate particles having an average primary particle size of 20 nm or more and 100 nm or less; and a toner, wherein a percentage of a silicone resin exposed on a surface of the carrier is 0.5 area % or more and 20 area % or less.

BRIEF DESCRIPTION OF THE DRAWINGS

Exemplary embodiments of the present disclosure will be described in detail based on the following figures, wherein.

Figure 1:
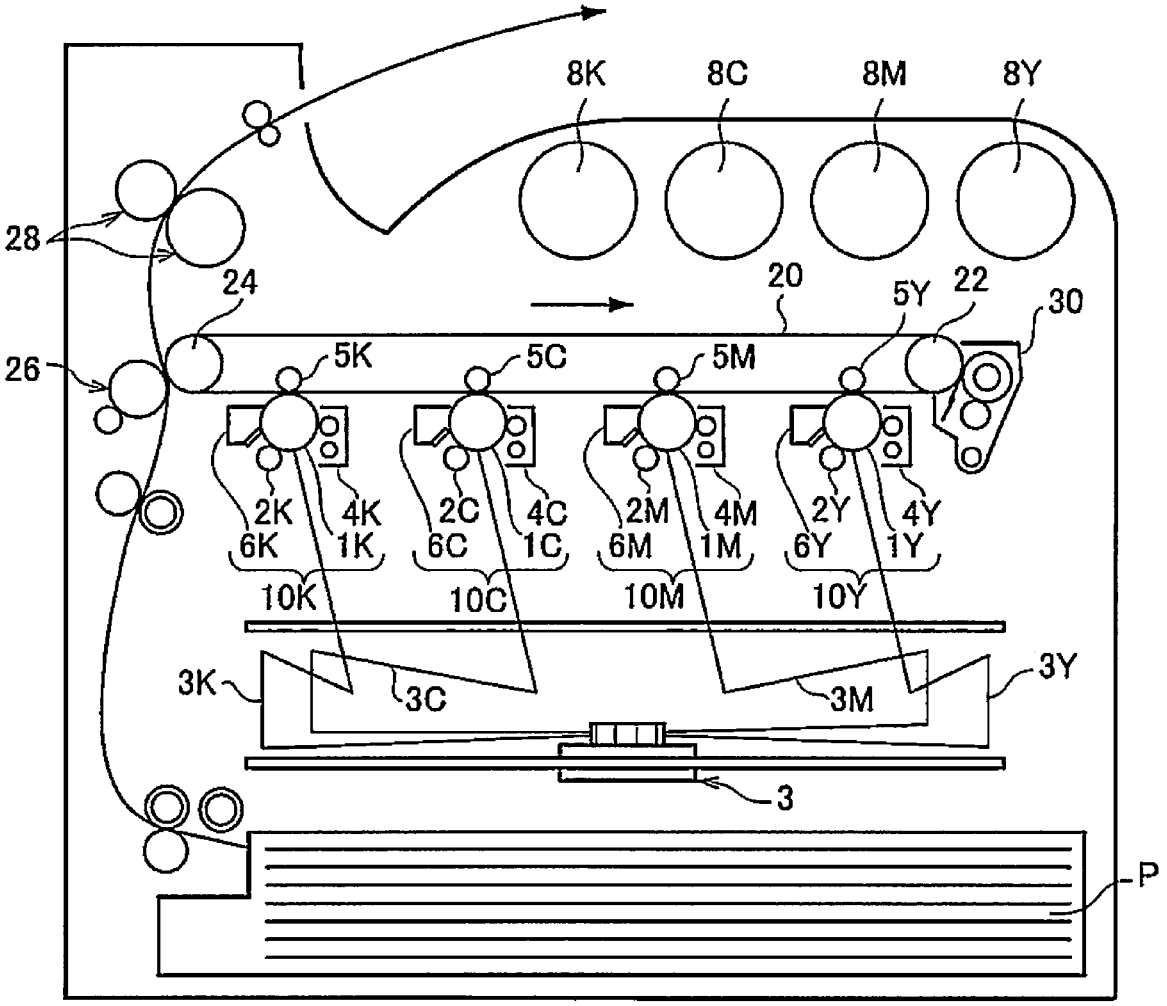
FIG. 1 is a schematic view of an image forming apparatus according to an exemplary embodiment.

In this specification, the amount of a component in a composition refers to, when there are several substances corresponding to the component in the composition, the total amount of the substances present in the composition, unless otherwise specified.

In this specification, the "electrostatic charge image development toner" is also referred to simply as "toner", and the "electrostatic charge image developer" is also referred to simply as a "developer."

Exemplary embodiments of the present disclosure will be described below.

DETAILED DESCRIPTION

Electrostatic Charge Image Development Toner

An electrostatic charge image developer according to an exemplary embodiment contains a carrier, strontium titanate particles, and a toner. The carrier includes a core and, on the core, a silicone resin-containing layer serving as a lower layer, and an acrylic resin-containing layer serving as an upper layer, or the carrier includes a silicone resin-containing core and an acrylic resin-containing layer on the silicone resin-containing core. The strontium titanate particles have an average primary particle size of 20 nm or more and 100 nm or less. The percentage of the silicone resin exposed on the surface of the carrier is 0.5 area % or more and 20 area % or less.

The electrostatic charge image developer according to this exemplary embodiment having the above feature may reduce occurrence of density unevenness in the initial printing stage after being left to stand in a high-temperature, high-humidity environment (28° C., 90% RH). The reason for this is not clear but assumed as described below.

The carrier including a core and, on the core, a silicone resin-containing layer serving as a lower layer, and an acrylic resin-containing layer serving as an upper layer, or the carrier including a silicone resin-containing core and an acrylic resin-containing layer on the silicone resin-containing core has a surface on which the silicone resin in the lower layer is exposed. The silicone resin may tend to inhibit triboelectric charging due to its low surface energy and cause charging failure. In particular, the silicone resin may make the charge amount uneven in electrification from the low charge state after the electrostatic charge image developer is left to stand in a high-temperature, high-humidity environment. The uneven charge amount may tend to cause density unevenness.

When the electrostatic charge image developer contains strontium titanate particles having an average primary particle size of 20 nm or more and 100 nm or less, the strontium titanate particles are likely to adhere to or reside on the silicone resin-exposed surface of the carrier.

A silicone resin-exposed portion has a structure with Si—O bonds, where the electron transfer distance is larger than that in the structure with C—C bonds and C—O bonds in an acrylic resin portion. The silicone resin-exposed portion may thus tend to attract strontium titanate particles having moderate polarization.

Strontium titanate particles with large polarization are readily charged because electron transfer easily occurs. The presence of strontium titanate particles that adhere to or reside on the silicone resin-exposed portion, which is formed after the coating layer in the carrier is peeled under the mechanical load during continuous printing, makes the charge amount appropriate even after the electrostatic charge image developer is left to stand in a high-temperature, high-humidity environment. This may reduce density unevenness in the initial printing stage.

The electrostatic charge image developer according to this exemplary embodiment will be described below in detail.

Carrier

The carrier used for the electrostatic charge image developer according to this exemplary embodiment is a carrier including a core and, on the core, a silicone resin-containing layer serving as a lower layer, and an acrylic resin-containing layer serving as an upper layer, or a carrier including a silicone resin-containing core and an acrylic resin-containing layer on the silicone resin-containing core. The percentage of the silicone resin exposed on the surface of the carrier is 0.5 area or more and 20 area or less.

To reduce density unevenness in the initial printing stage after the electrostatic charge image developer is left to stand in a high-temperature, high-humidity environment, the carrier is preferably a carrier including a silicone resin-containing core and an acrylic resin-containing layer on the silicone resin-containing core.

Percentage of Silicone Resin Exposed on Surface of Carrier

The percentage of the silicone resin exposed on the surface of the carrier used in this exemplary embodiment is 0.5 area % or more and 20 area % or less. To reduce density unevenness in the initial printing stage after the electrostatic charge image developer is left to stand in a high-temperature, high-humidity environment, the percentage of the silicone resin exposed on the surface of the carrier is preferably 0.6 area % or more and 10 area % or less, more preferably 0.7 area % or more and 5 area % or less, and still more preferably 0.8 area % or more and 2 area % or less.

The percentage of the silicone resin exposed on the surface of the carrier in this exemplary embodiment is determined as follows: detecting the ratio of C, O, Fe, Mn, Mg, and Si elements on the surface of the carrier by using an X-ray photoelectron spectrometer (XPS); determining the ratio of the peak from Si element; and calculating the area ratio of Si element as the amount of the exposed silicone resin.

The X-ray photoelectron spectrometer may be, for example, JPS-9000MX (available from JEOL Ltd.).

Surface Roughness Ra of Carrier

To reduce density unevenness in the initial printing stage after the electrostatic charge image developer is left to stand in a high-temperature, high-humidity environment, the surface roughness Ra of the carrier in this exemplary embodiment is preferably 0.2 μm or more and 1.5 μm or less, more preferably 0.3 μm or more and 0.9 μm or less, and still more preferably 0.4 μm or more and 0.8 μm or less.

In this exemplary embodiment, the surface roughness Ra of the carrier is determined by the following method.

The method for determining the Ra (arithmetic average roughness) of the surface of the carrier involves calculating the Ra through observation of 2,000 particles of the carrier under an ultra-depth color 3D profile measuring microscope (VK9700 available from Keyence Corporation) at a magnification of 1,000 times. This method is based on JIS B 0601 (1994). Specifically, the Ra of the carrier surface is determined as follows: obtaining the roughness curve from the three-dimensional profile of the carrier surface observed under the microscope; summing the absolute values of deviations between the measured values and the average value on the roughness curve; and averaging the summed values. In the determination of the Ra of the carrier surface, the reference length is 10 μm, and the cutoff value is 0.08 mm.

Core

Examples of magnetic materials for forming the core include magnetic metals, such as iron, steel, nickel, and cobalt; alloys containing these magnetic metals and manganese, chromium, rare-earth elements, or the like; and magnetic oxides, such as ferrite and magnetite.

The silicone resin-containing core may be a magnetic particle-dispersed core in which the magnetic material is dispersed in a silicone resin described below as a matrix resin, or a resin-impregnated core in which a porous magnetic material is impregnated with a silicone resin. The silicone resin-containing core may contain, as a matrix resin, a resin other than a silicone resin. The amount of the silicone resin relative to the total mass of the matrix resin in the core is preferably 50 mass % or more, more preferably 80 mass % or more, and still more preferably 90 mass % or more and 100 mass % or less.

The core is obtained by magnetic granulation and sintering, and the magnetic material may be ground in the pretreatment. The grinding method may be any known grinding method. Specifically, for example, a mortar, a ball mill, or a jet mill may be used.

The volume-average particle size of the core is preferably 10 μm or more and 500 μm or less, more preferably 20 μm or more and 100 μm or less, and still more preferably 20 μm or more and 40 μm or less.

The volume-average particle size of the core is measured with a laser diffraction/scattering particle size distribution analyzer.

Silicone Resin

The carrier contains a silicone resin as a resin in the lower layer on the core or in the magnetic particle-dispersed core or the resin-impregnated core.

The silicone resin may be any known silicone resin. The silicone resin is any siloxane polymer having Si—O—Si bonds in the main chain and having an organic group, such as a methyl group or a phenyl group, in the side chain. Examples of suitable silicone resins include an unbranched straight silicone resin having —Si($R^1R^2$)—O— ($R^1$ and $R^2$ each independently represent an alkyl group or an aryl group, preferably a methyl group or a phenyl group) in the main chain, and a modified silicone resin obtained by modifying the straight silicone resin with alkyd, acrylic, epoxy, urethane, or the like.

The straight silicone resin is preferably dimethyl polysiloxane or methyl phenyl polysiloxane.

The modified silicone resin is preferably an alkyd-modified silicone resin, an acrylic-modified silicone resin, an epoxy-modified silicone resin, or a urethane-modified silicone resin, and more preferably an acrylic-modified silicone resin.

The weight-average molecular weight of the silicone resin is 10,000 or more, more preferably 15,000 or more, and still more preferably 20,000 or more.

The upper limit of the weight-average molecular weight is not limited, but may be 300,000 or less, and preferably 200,000 or less.

The straight silicone resin may be a commercial product. Examples of commercial products include KR271, KR255, and KR152 available from Shin-Etsu Chemical Co., Ltd.; and silicone SR2400, SR2406, and SR2410 available from Dow Corning Toray Co., Ltd.

The modified silicone resin may be a commercial product. Examples of commercial products include KR206 (alkyd-modified), KR5208 (acrylic-modified), ES1001N (epoxy-modified), and KR305 (urethane-modified) available from Shin-Etsu Chemical Co., Ltd.; and silicone SR2115 (epoxy-modified) and SR2110 (alkyd-modified) available from Dow Corning Toray Co., Ltd.

These silicone resins may be used alone or in combination of two or more.

In the case where the lower layer on the core contains a silicone resin, the amount of the silicone resin in the lower layer relative to the total mass of the lower layer is preferably 50 mass % or more, more preferably 80 mass % or more, and still more preferably 90 mass % or more and 100 mass % or less.

In view of charging stability, the average thickness of the lower layer containing the silicone resin in the carrier is preferably 0.1 μm or more and 5 μm or less, more preferably 0.2 μm or more and 3 μm or less, and still more preferably 0.3 μm or more and 2 μm or less.

The average thickness of each layer is determined as follows: cutting the particles of the carrier along the surface including the center (preferably, center of gravity) of the particles of the carrier; and measuring and averaging the thickness of each layer in 10 or more particles of the carrier through observation of the cross section.

Acrylic Resin

The carrier has an acrylic resin-containing layer on its core. The acrylic resin-containing layer may be the outermost layer of the carrier.

The acrylic resin-containing layer does not completely cover the carrier. The acrylic resin-containing layer is not formed on part of the surface of the carrier. The silicone resin is exposed on part of the surface of the carrier.

Examples of the acrylic resin include, but are not limited to, homopolymers or copolymers of (meth)acrylic compounds, such as methyl methacrylate, methyl acrylate, propyl methacrylate, propyl acrylate, lauryl acrylate, cyclohexyl methacrylate, cyclohexyl acrylate, methacrylic acid, acrylic acid, butyl methacrylate, butyl acrylate, 2-ethylhexyl acrylate, ethyl methacrylate, dimethylaminoethyl methacrylate, acrylonitrile, and methacrylonitrile.

To ensure low hygroscopicity and to reduce density unevenness in the initial printing stage after the electrostatic charge image developer is left to stand in a high-temperature, high-humidity environment, the acrylic resin is preferably a homopolymer or copolymer of an alicyclic alkyl (meth)acrylate compound, such as cyclohexyl (meth)acrylate, and more preferably a homopolymer or copolymer of a cyclohexyl (meth)acrylate.

The acrylic resin in this exemplary embodiment has a structural unit derived from a (meth)acrylic compound in an amount of 50 mass % or more, preferably 80 mass % or more, and more preferably 90 mass % or more.

The acrylic resin in this exemplary embodiment may have a structural unit derived from a monomer other than a (meth)acrylic compound.

The weight-average molecular weight of the acrylic resin is preferably 5,000 or more and 1,000,000 or less, and more preferably 10,000 or more and 200,000 or less.

The glass transition temperature (Tg) of the acrylic resin is preferably, but not necessarily, from 50° C. to 150° C., more preferably from 70° C. to 120° C., and still more preferably from 80° C. to 120° C.

The glass transition temperature of the resin is determined by using a differential scanning calorimeter (DSC) measurement method and obtained from the primary maximum peak measured in conformity with ASTM D3418-8. The primary maximum peak is measured using DSC-7 available from PerkinElmer, Co., Ltd. Temperature calibration of the detector in the device is performed using the melting point of indium and zinc, and calibration for the amount of heat is performed using the heat of fusion of indium. An aluminum pan is used as a sample pan, and an empty pan is set as reference. The heating rate is 10° C./min.

In view of charging stability, the average thickness of the acrylic resin-containing layer in the carrier is preferably 0.1 μm or more and 5 μm or less, more preferably 0.5 μm or more and 3 μm or less, and still more preferably 0.7 μm or more and 2 μm or less.

In the carrier including, on the core, the silicone resin-containing layer serving as a lower layer, and the acrylic resin-containing layer serving as an upper layer, the average thickness of the lower layer may be larger than the average thickness of the upper layer to reduce density unevenness in the initial printing stage after the electrostatic charge image developer is left to stand in a high-temperature, high-humidity environment.

In the carrier used in this exemplary embodiment, the core, the silicone resin-containing layer, and the acrylic resin-containing layer may further contain additives.

Examples of additives include known additives, such as a cross-linker and a conductive powder.

In the carrier used in this exemplary embodiment, at least one of the core, the silicone resin-containing layer, and the acrylic resin-containing layer may contain a cross-linker.

The cross-linker is a component that induces the cross-linking reaction, preferably a component that thermally induces the cross-linking reaction.

Examples of the cross-linker include known cross-linkers, such as a silane coupling agent.

The amount of the cross-linker relative to the total mass of the layers in the carrier is preferably from 0.1 mass % to 10 mass %, more preferably from 0.2 mass % to 8 mass %, and still more preferably from 0.5 mass % to 5 mass %.

In the carrier used in this exemplary embodiment, at least one of the silicone resin-containing layer and the acrylic resin-containing layer may contain a conductive powder.

Examples of the conductive powder include metal powders, carbon black, titanium oxide, tin oxide, and zinc oxide. The number-average particle size of the conductive powder may be 1 μm or less. When the number-average particle size is 1 μm or more, it is easy to control electrical resistance.

The amount of the conductive powder relative to the total mass of the layers in the carrier is preferably from 0.1 mass % to 10 mass %, more preferably from 0.2 mass % to 8 mass %, and still more preferably from 0.5 mass % to 5 mass %.

Physical Properties of Carrier

The volume-average particle size of the carrier is preferably 10 μm or more and 500 μm or less, more preferably 20 μm or more and 100 μm or less, and still more preferably 20 μm or more and 40 μm or less.

The volume-average particle size of the carrier is measured with a laser diffraction/scattering particle size distribution analyzer.

The volume electrical resistivity (25° C.) of the carrier is preferably $1\times10^{7}$ Ω·cm or more and $1\times10^{15}$ Ω·cm or less, more preferably $1\times10^{8}$ Ω·cm or more and $1\times10^{14}$ Ω·cm or less, and still more preferably $1\times10^{8}$ Ω·cm or more and $1\times10^{13}$ Ω·cm or less.

Method for Producing Carrier

The carrier used in this exemplary embodiment is formed as follows: for example, preparing a coating solution by dissolving a silicone resin or the like in an organic solvent; then applying the coating solution to the surface of core particles by a known application method, followed by drying and baking; preparing a coating solution by dissolving an acrylic resin or the like in an organic solvent; and then applying the coating solution to the silicone resin-containing lower layer or the surface of the silicone resin-containing core by a known application method, followed by drying and baking. Examples of the application method include, but are not limited to, known application methods, such as an immersion method, a spray method, and a brush coating method.

The organic solvent is not limited and appropriately selected according to the intended purpose. Examples of the organic solvent include toluene, xylene, methyl ethyl ketone, methyl isobutyl ketone, Cellosolve, and butyl acetate.

The resin layer may be baked by using any method, and may be baked by using an external heating method or an internal heating method. Examples of the method include methods using a stationary electric furnace, a fluid electric furnace, a rotary electric furnace, burner furnace, microwaves, or the like.

The amount of each layer relative to the total mass of the carrier is preferably 0.01 mass % or more and 20 mass % or less, and more preferably 0.5 mass % or more and 10 mass % or less.

The mixing ratio (mass ratio) of the toner to the carrier in the electrostatic charge image developer according to this exemplary embodiment is preferably from 1:100 to 30:100 (=toner:carrier), and more preferably from 3:100 to 20:100.

Strontium Titanate Particles

The electrostatic charge image developer according to this exemplary embodiment contains strontium titanate ($SrTiO_3$) particles having an average primary particle size of 20 nm or more and 100 nm or less.

The strontium titanate particles may be or may not be an external additive for the toner. At least some of the strontium titanate particles may be present as an external additive for the toner.

The average primary particle size of the strontium titanate particles is 20 nm or more and 100 nm or less. To reduce density unevenness in the initial printing stage after the electrostatic charge image developer is left to stand in a high-temperature, high-humidity environment, the average primary particle size of the strontium titanate particles is preferably 30 nm or more and 80 nm or less, and more preferably 30 nm or more and 60 nm or less.

The primary particle size of the strontium titanate particles is a diameter of a circle having the same area as the primary particle image (that is, equivalent circle diameter). The average primary particle size of the strontium titanate particles is a particle size at cumulative 50% from the smaller particle size side in the number-based primary particle size distribution.

The average primary particle size of the strontium titanate particles is determined by capturing the scanning electron microscope (SEM) image of the strontium titanate particles, and analyzing at least 300 strontium titanate particles in the SEM image.

The average primary particle size of the strontium titanate particles may be controlled by regulating the average primary particle size of strontium titanate particles used as an external additive.

The average primary particle size of the strontium titanate particles used as an external additive may be controlled by, for example, the conditions for producing the strontium titanate particles by a wet method.

Average Circularity of Primary Particles and Circularity at Cumulative 84%

The average circularity of primary particles of the strontium titanate particles is preferably 0.82 or more and 0.94 or less, and the circularity of the primary particles at cumulative 84% is preferably more than 0.92, to reduce density unevenness in the initial printing stage after the electrostatic charge image developer is left to stand in a high-temperature, high-humidity environment.

With regard to the strontium titanate particles, the average circularity of the primary particles may hereinafter be referred to as "average circularity", and the circularity of the primary particles at cumulative 84% may hereinafter be referred to as "circularity at cumulative 84%".

When the average circularity and the circularity at cumulative 84% are in the foregoing ranges, the strontium titanate particles are present on the surface of the toner particles so as to have few corners. This configuration may suppress fogging in an image just after startup of an image forming apparatus caused by concentration of charges at the corners of the strontium titanate particles and also may reduce density unevenness in the initial printing stage.

The fact that the average circularity and the circularity at cumulative 84% of the strontium titanate particles are in the foregoing ranges means that the strontium titanate particles used as an external additive have a shape with round corners. Therefore, for use as an external additive, the strontium titanate particles having a shape with round corners may be more readily dispersible on the surface of the toner particles than strontium titanate particles having a cubic or rectangular parallelepiped shape.

In this exemplary embodiment, the circularity of the primary particles of the strontium titanate particles is $4\pi\times$ (area of primary particle image)/(circumference of primary particle image)$^2$. The average circularity of the primary particles is the circularity at cumulative 50% from the smaller circularity side in the circularity distribution. The circularity of the primary particles at cumulative 84% is the circularity at cumulative 84% from the smaller circularity side in the circularity distribution.

The circularity of the strontium titanate particles is determined by capturing the SEM image of the strontium titanate particles and analyzing at least 300 strontium titanate particles in the SEM image.

The average circularity of the strontium titanate particles is preferably 0.82 or more and 0.94 or less, more preferably 0.84 or more and 0.94 or less, and still more preferably 0.86 or more and 0.92 or less, to reduce density unevenness in the initial printing stage after the electrostatic charge image developer is left to stand in a high-temperature, high-humidity environment.

The circularity of the primary particles of the strontium titanate particles at cumulative 84% is preferably more than 0.92, more preferably 0.930 or more and 0.970 or less, still more preferably 0.940 or more and 0.965 or less, and yet still more preferably 0.945 or more and 0.960 or less, to reduce density unevenness in the initial printing stage after the electrostatic charge image developer is left to stand in a high-temperature, high-humidity environment.

In order that the strontium titanate particles satisfy the foregoing average circularity and the foregoing circularity at cumulative 84%, the strontium titanate particles are preferably strontium titanate particles having a round shape.

The average circularity and the circularity at cumulative 84% of the strontium titanate particles may be controlled by regulating the average circularity and the circularity at cumulative 84% of strontium titanate particles that may be used as an external additive.

The average circularity and the circularity at cumulative 84% of the strontium titanate particles used as an external additive may be controlled by, for example, the conditions for producing the strontium titanate particles by a wet method, a doping metal element, which is a metal element other than titanium and strontium, and the amount of the doping metal element.

Standard Deviation of Circularity of Primary Particles

To suppress fogging in an image just after startup of an image forming apparatus, the standard deviation of the circularity of the primary particles of the strontium titanate particles used in this exemplary embodiment is preferably 0.04 or more and 2.0 or less, more preferably 0.04 or more and 1.0 or less, and still more preferably 0.04 or more and 0.50 or less.

Strontium titanate particles having a cubic or rectangular parallelepiped shape tend to exhibit a narrow circularity distribution due to their shape. Therefore, the strontium titanate particles whose circularity of primary particles have a standard deviation in the foregoing range indicate that the strontium titanate particles do not include a large amount of strontium titanate particles having a cubic or rectangular parallelepiped shape.

Therefore, the strontium titanate particles whose circularity of primary particles have a standard deviation in the foregoing range are present on the surface of the toner particles so as to have few corners. This configuration may tend to suppress fogging in an image just after startup of an image forming apparatus caused by concentration of charges at the corners of the strontium titanate particles and also may tend to reduce density unevenness in the initial printing stage.

The standard deviation of the circularity of the primary particles is a standard deviation of the circularity of at least 300 strontium titanate particles that have undergone image analysis to determine the circularity described above.

The determination of the standard deviation of the circularity of the primary particles may be performed simultaneously with the determination of the average circularity and the circularity at cumulative 84%.

To calculate the standard deviation of the circularity, the primary particles are analyzed after the strontium titanate particles having a primary particle size of 20 nm or less are removed.

Amount

The amount of the strontium titanate particles in the electrostatic charge image developer according to this exemplary embodiment is preferably 0.01 parts by mass or more and 5 parts by mass or less, more preferably 0.1 parts by mass or more and 3.5 parts by mass or less, and still more preferably 0.5 parts by mass or more and 2 parts by mass or less per 100 parts by mass of the amount of the toner in the electrostatic charge image developer, to reduce density unevenness in the initial printing stage after the electrostatic charge image developer is left to stand in a high-temperature, high-humidity environment.

The amount of the strontium titanate particles is preferably 10 area % or more and 40 area % or less, and more preferably 15 area % or more and 25 area % or less in terms of coverage of the toner, to reduce density unevenness in the initial printing stage after the electrostatic charge image developer is left to stand in a high-temperature, high-humidity environment.

In this exemplary embodiment, the amount of the strontium titanate particles in terms of coverage of the toner is calculated on the basis of the amount of the strontium titanate particles, and the volume-average particle size and the average circularity of the toner.

C(t)/C(c)

The ratio C(t)/C(c) of the amount C(t) (area %) of the strontium titanate particles in terms of coverage of the toner to the percentage C(c) (area %) of the silicone resin exposed on the surface of the carrier is preferably more than 0.5 and 45 or less, more preferably 1 or more and 40 or less, and still more preferably 5 or more and 30 or less, to reduce density unevenness in the initial printing stage after the electrostatic charge image developer is left to stand in a high-temperature, high-humidity environment.

Amount of Strontium Titanate Particles Other than Free Particles and Firmly Adhering Particles The amount of the strontium titanate particles other than the strontium titanate particles being free and the strontium titanate particles firmly adhering to the toner is preferably 10 mass % or more and 70 mass % or less, more preferably 20 mass % or more and 65 mass % or less, and still more preferably 25 mass % or more and 60 mass % or less relative to the total mass of the strontium titanate particles, to reduce density unevenness in the initial printing stage after the electrostatic charge image developer is left to stand in a high-temperature, high-humidity environment.

The amount of the strontium titanate particles other than the strontium titanate particles being free and the strontium titanate particles firmly adhering to the toner is determined in the following method. To a 200 mL glass bottle are added 40 mL of a 0.2 mass Triton X-100 aqueous solution (available from Acros Organics) and 2.0 g of a test sample. The mixture is stirred by gently shaking the sealed bottle and then left to stand for 1 hour. The supernatant is removed, and the precipitate is washed with ion exchange water and filtered. The residue is dried in an oven for 1 hour or longer. The amount of free strontium titanate particles is calculated from differences in X-ray fluorescence intensities of the elements between the dried toner and the untreated toner.

By using an ultrasonic homogenizer (US-300AT available from Nippon Seiki Co., Ltd.), ultrasonic waves are applied to a sample that has been treated in the same manner and left to stand for 1 hour. The application of ultrasonic waves are performed under the following conditions: application time: 300 seconds continuously; output: 75 W; amplitude: 180 μm; and distance between ultrasonic vibrator and container bottom surface: 10 mm. Next, the dispersion is centrifuged in a compact, high-speed centrifuge (refrigeration) (M201-IVD available from Sakuma) at 3,000 rpm at a cooling temperature of 0° C. for 2 minutes. The supernatant is removed, and the residual slurry is filtered through filter paper (qualitative filter paper No. 5C, 110 nm, available from Advantec Toyo Kaisha, Ltd.). The residue on the filter paper is washed with ion exchange water twice and dried to provide a test sample. The total amount of free strontium titanate particles and strontium titanate particles weakly and moderately adhering to the toner is calculated from differences in X-ray fluorescence intensities of the elements between the obtained toner and the untreated toner.

The amount of strontium titanate particles weakly and moderately adhering to the toner (the amount of strontium titanate particles other than free particles and firmly adhering particles is calculated from the amount of free strontium titanate particles and the total amount of free strontium titanate particles and strontium titanate particles weakly and moderately adhering to the toner.

Da/Ra

The ratio Da/Ra of the average primary particle size Da (nm) of the strontium titanate particles to the surface roughness Ra (μm) of the carrier is preferably 2 or more and 200 or less, more preferably 2 or more and 100 or less, still more preferably 3 or more and 45 or less, to reduce density unevenness in the initial printing stage after the electrostatic charge image developer is left to stand in a high-temperature, high-humidity environment.

Width at Half Maximum of Peak from (110) Plane in X-ray Diffraction Analysis

The width at half maximum of the peak from the (110) plane in X-ray diffraction analysis of the strontium titanate particles is preferably 0.2° or more and 2.0° or less, more preferably 0.2° or more and 1.0° or less, still more preferably 0.25° or more and 0.80° or less, and yet still more preferably 0.25° or more and 0.50° or less, to reduce density unevenness in the initial printing stage after the electrostatic charge image developer is left to stand in a high-temperature, high-humidity environment.

The peak from the (110) plane in X-ray diffraction analysis of the strontium titanate particles appears at a diffraction angle 2θ of about 32°. This peak corresponds to the peak from the (110) plane of the perovskite crystal.

Strontium titanate particles with a cubic or rectangular parallelepiped shape have a highly crystalline perovskite structure. The width at half maximum of the peak from the (110) plane of such strontium titanate particles is usually less than 0.2°. For example, the analysis of SW-350 (strontium titanate particles mainly having a cubic shape) available from Titan Kogyo, Ltd. indicates that the width at half maximum of the (110) plane is 0.15°.

Strontium titanate particles with a round shape have a relatively low crystalline perovskite structure and exhibit a large width at half maximum of the peak from the (110) plane.

The X-ray diffraction of the strontium titanate particles is analyzed with an X-ray diffractometer (e.g., product name: RINT Ultima-III available from Rigaku Corporation). The analysis conditions are as follows: radiation source: Cu Kα; voltage: 40 kV; current: 40 mA; sample rotation speed: no rotation; divergence slit: 1.00 mm; divergence longitudinal restriction slit: 10 mm; scattering slit: open; receiving slit: open; scan mode: FT; counting time: 2.0 seconds; step interval: 0.0050°; and operation axis: 10.0000° to 70.0000°. In the present disclosure, the width at half maximum of peaks in the X-ray diffraction pattern refers to the full width at half maximum.

Dopant

The strontium titanate particles may be doped with a metal element (hereinafter may be referred to as a dopant) other than titanium and strontium. The dopant in the strontium titanate particles may reduce the crystallinity of the perovskite structure and may lead to a round shape.

The dopant for the strontium titanate particles is any metal element other than titanium and strontium. The dopant may be a metal element that has, when ionized, an ionic radius that allows the ionized metal element to enter the crystal structure of the strontium titanate particles. In view of this, the dopant for the strontium titanate particles is preferably a metal element that has, when ionized, an ionic radius of 40 pm or more and 200 pm or less, and more preferably a metal element that has, when ionized, an ionic radius of 60 pm or more and 150 pm or less.

Specific examples of the dopant for the strontium titanate particles include lanthanoids, silica, aluminum, magnesium, calcium, barium, vanadium, chromium, manganese, iron, cobalt, nickel, copper, zinc, gallium, niobium, molybdenum, ruthenium, palladium, indium, antimony, tantalum, tungsten, rhenium, iridium, platinum, bismuth, yttrium, zirconium, niobium, silver, and tin. Among lanthanoids, lanthanum and cerium are preferred. Among these, lanthanum is preferred because of ease in doping and ease in controlling the shape of strontium titanate particles.

The dopant for the strontium titanate particles is preferably a metal element having an electronegativity of 2.0 or less, and more preferably a metal element having an electronegativity of 1.3 or less, to reduce density unevenness in the initial printing stage after the electrostatic charge image developer is left to stand in a high-temperature, high-humidity environment and to prevent the strontium titanate particles from being excessively negatively charged. The electronegativity in this exemplary embodiment is the All-red-Rochow electronegativity.

Suitable metal elements having an electronegativity of 2.0 or less are listed below together with their electronegativity.

Examples of metal elements having an electronegativity of 2.0 or less include lanthanum (1.08), magnesium (1.23), aluminum (1.47), silica (1.74), calcium (1.04), vanadium (1.45), chromium (1.56), manganese (1.60), iron (1.64), cobalt (1.70), nickel (1.75), copper (1.75), zinc (1.66), gallium (1.82), yttrium (1.11), zirconium (1.22), niobium (1.23), silver (1.42), indium (1.49), tin (1.72), barium (0.97), tantalum (1.33), rhenium (1.46), and cerium (1.06).

Among these, the dopant is preferably lanthanum (La) or silicon (Si), and more preferably lanthanum to reduce density unevenness in the initial printing stage after the electrostatic charge image developer is left to stand in a high-temperature, high-humidity environment.

The amount of the dopant in the strontium titanate particles relative to strontium is preferably in the range of 0.1 mol % or more and 20 mol % or less, more preferably in the range of 0.1 mol % or more and 15 mol % or less, and still more preferably in the range of 0.1 mol % or more and 10 mol % or less in order that the strontium titanate particles have a round shape while having a perovskite crystal structure.

Water Content

The water content of the strontium titanate particles is preferably 1.5 mass % or more and 10 mass % or less. When the water content is 1.5 mass % or more and 10 mass % or less (more preferably 2 mass % or more and 5 mass % or less), the strontium titanate particles may have a resistance in an appropriate range and may reduce occurrence of fogging.

The water content of the strontium titanate particles in the foregoing range is achieved by controlling the conditions (temperature and time) for drying strontium titanate particles produced by a wet method.

In the case where the surface of the strontium titanate particles is hydrophobized, the water content in the foregoing range is achieved by controlling the drying conditions after hydrophobization.

The water content of the strontium titanate particles is determined as described below.

The moisture in a test sample (20 mg) is controlled by leaving the test sample in a chamber at temperature 22° C./relative humidity 55% for 17 hours. The test sample is then heated from 30° C. to 250° C. at a heating rate of 30° C./min in a nitrogen gas atmosphere by using a thermobalance (TGA-50 model available from Shimadzu Corporation) in a room at temperature 22° C./relative humidity 55%, and the weight loss on heating (loss in mass on heating) is measured.

The water content is calculated on the basis of the measured weight loss on heating in accordance with the following formula.

Water content (mass %)=(weight loss on heating from 30° C. to 250° C.)/(mass before heating after moisture control)×100

Hydrophobization

The strontium titanate particles are preferably strontium titanate particles having the hydrophobized surface, and more preferably strontium titanate particles having the surface hydrophobized with a silicon-containing organic compound, to improve the effect of the strontium titanate particles.

Examples of the silicon-containing organic compound include alkoxysilane compounds, silazane compounds, and silicone oils. The silicon-containing organic compound is preferably at least one compound selected from the group consisting of alkoxysilane compounds and silicone oils.

The silicon-containing organic compound will be described in detail in the section of the method for producing strontium titanate particles.

The strontium titanate particles preferably have the surface containing a silicon-containing organic compound in an amount of 1 mass % or more and 50 mass % or less (preferably 5 mass % or more and 40 mass % or less, more preferably 5 mass % or more and 30 mass % or less, and still more preferably 10 mass % or more and 25 mass % or less) relative to the mass of the strontium titanate particles.

In other words, the amount of the silicon-containing organic compound involved in hydrophobization is preferably 1 mass % or more and 50 mass % or less, more preferably 5 mass % or more and 40 mass % or less, still more preferably 5 mass % or more and 30 mass % or less, and yet still more preferably 10 mass % or more and 25 mass % or less relative to the mass of the strontium titanate particles.

When the amount of the silicon-containing organic compound involved in hydrophobization is 1 mass % or more, the toner charge amount may be sufficient even at high temperature and high humidity, and it may be easy to reduce occurrence of fogging. When the amount of the silicon-containing organic compound involved in hydrophobization is 50 mass % or less, the toner saturation charge amount may not be too high at low temperature and low humidity, and it may be easy to reduce occurrence of fogging. When the amount of the silicon-containing organic compound involved in hydrophobization is 30 mass % or less, it may be easy to reduce generation of aggregates formed due to the hydrophobized surface.

The mass ratio Si/Sr of silicon (Si) to strontium (Sr) in the hydrophobized surface of the strontium titanate particles as determined by qualitative and quantitative X-ray fluorescence analysis is preferably 0.025 or more and 0.25 or less, and more preferably 0.05 or more and 0.20 or less, to improve the effect of the strontium titanate particles.

The X-ray fluorescence analysis of the hydrophobized surface of the strontium titanate particles is carried out by the following method.

Specifically, an X-ray fluorescence spectrometer (XRF-1500 available from Shimadzu Corporation) is used to perform qualitative and quantitative analysis under the following conditions: X-ray output: 40 V, 70 mA, measurement area: ϕ 10 mm, and measurement time: 15 minutes. The elements to be analyzed are oxygen (O), silicon (Si), titanium (Ti), strontium (Sr), and a metal element (Me) other than titanium (Ti) and strontium (Sr). The mass ratio (%) of each elemental is calculated from the total mass of the detected elements with reference to, for example, the separately created calibration curve data that enable quantification of each element.

The mass ratio Si/Sr is calculated on the basis of the mass ratio of silicon (Si) and the mass ratio of strontium (Sr) determined in this analysis.

Specific Volume Resistivity

The specific volume resistivity R1 (Ω·cm) of the strontium titanate particles in terms of common logarithm log R1 is preferably 11 or more and 14 or less, more preferably 11 or more and 13 or less, and still more preferably 12 or more and 13 or less, to improve toner charging characteristics and reduce occurrence of fogging.

The specific volume resistivity R1 of the strontium titanate particles is determined as described below.

The strontium titanate particles are placed on the lower electrode plate of a measuring jig, which is a pair of 20-$cm^2$ circular electrode plates connected to an electrometer (Keithley 610C available from Keithley Instruments, LLC) and a high-voltage power supply (Fluke 415B available from Fluke Corporation) such that the strontium titanate particles form a flat layer having a thickness in the range of 1 mm or more and 2 mm or less.

The moisture in the formed strontium titanate particle layer is then controlled at 22° C. and 55% RH for 24 hours.

Next, in an environment at 22° C. and 55% RH, an upper electrode plate is placed on the strontium titanate particle layer whose moisture content has been controlled, and a 4-kg weight is placed on the upper electrode plate to remove the voids in the strontium titanate particle layer. In this state, the thickness of the strontium titanate particle layer is measured. Next, a voltage of 1000 V is applied across the electrode plates to determine the current, and the specific volume resistivity R1 is calculated in accordance with the following formula (1).

$$\text{Specific volume resistivity } R1(\Omega\cdot\text{cm}) = V \times S/(A1 - A0)/d \qquad \text{Formula (1):}$$

wherein V is an applied voltage of 1000 (V), S is an electrode plate area of 20 ($cm^2$), A1 is a measured current (A), A0 is an initial current (A) at an applied voltage of 0 V, and d is a thickness (cm) of the strontium titanate particle layer.

The specific volume resistivity R1 of the strontium titanate particles may be controlled by, for example, the specific volume resistivity R2 of the strontium titanate particles before hydrophobization (R2 changes with water content, the type of dopant, the amount of dopant, and the like), the type of hydrophobizing agent, the amount of hydrophobizing agent involved in hydrophobization, the drying temperature and drying time after hydrophobization, and the like. The specific volume resistivity R1 is preferably controlled by at least one of the water content of the strontium titanate particles before hydrophobization, and the amount of hydrophobizing agent involved in hydrophobization.

The specific volume resistivity R2 of the strontium titanate particles before hydrophobization in terms of common logarithm log R2 is preferably 6 or more and 10 or less, and more preferably 7 or more and 9 or less. In other words, the resistance under the hydrophobized surface of the strontium titanate particles is the foregoing resistance. The strontium titanate particles have a low resistance inside, and surface hydrophobization increases the resistance of the particles. This may improve toner charging characteristics. In this exemplary embodiment, a difference (log R1−log R2) between the common logarithm log R1 of the specific volume resistivity R1 and the common logarithm log R2 of the specific volume resistivity R2 is preferably 2 or more and 7 or less and more preferably 3 or more and 5 or less, to improve toner charging characteristics and ensure image density.

The specific volume resistivity R2 of the strontium titanate particles before surface hydrophobization may be controlled by, for example, the water content of the strontium titanate particles, the type of dopant, and the amount of dopant.

The specific volume resistivity R2 of the strontium titanate particles before hydrophobization is determined by using the same method as for the specific volume resistivity R1.

Method for Producing Strontium Titanate Particles

The strontium titanate particles used as an external additive are produced by, if necessary, hydrophobizing the surface of strontium titanate particles after production of the strontium titanate particles.

The method for producing strontium titanate particles is preferably, but not necessarily, a wet method to control particle size and shape.

Production of Strontium Titanate Particles

The wet method for producing the strontium titanate particles involves, for example, adding an alkaline aqueous solution to a mixture of a titanium oxide source and a strontium source to cause reaction and then performing an acid treatment. In this production method, the particle size of the strontium titanate particles is controlled by the mixing ratio of the strontium source to the titanium oxide source, the concentration of the titanium oxide source in the initial reaction stage, the temperature and the rate at which the alkaline aqueous solution is added, and the like.

Examples of the titanium oxide source include a mineral acid deflocculation product of a hydrolysate of a titanium compound. Examples of the strontium source include strontium nitrate and strontium chloride.

The mixing ratio of the strontium source to the titanium oxide source in terms of $SrO/TiO_2$ molar ratio is preferably 0.9 or more and 1.4 or less, and more preferably 1.05 or more and 1.20 or less. The concentration of the titanium oxide source in the initial reaction stage in terms of $TiO_2$ is preferably 0.05 mol/L or more and 1.3 mol/L or less, and more preferably 0.5 mol/L or more and 1.0 mol/L or less.

To control the resistance of the strontium titanate particles, a dopant source may be added to the mixture of the titanium oxide source and the strontium source. Examples of the dopant source include oxides of metals other than titanium and strontium. A metal oxide serving as a dopant source is added in the form of, for example, a solution of the metal oxide in nitric acid, hydrochloric acid, sulfuric acid, or the like. The amount of the dopant source added in terms of metal serving as a dopant is preferably 0.1 mol or more and 10 mol or less, and more preferably 0.5 mol or more and 10 mol or less per 100 mol of strontium.

The dopant source may be added when the alkaline aqueous solution is added to the mixture of the titanium oxide source and the strontium source. In this case, the metal oxide serving as the dopant source may also be added in the form of a solution of the metal oxide in nitric acid, hydrochloric acid, or sulfuric acid.

The alkaline aqueous solution may be an aqueous sodium hydroxide solution. The higher the temperature at which the alkaline aqueous solution is added, the higher the tendency to obtain strontium titanate particles with appropriate crystallinity. In this exemplary embodiment, the temperature at which the alkaline aqueous solution is added may be in the range of 60° C. or higher and 100° C. or lower.

The lower the rate at which the alkaline aqueous solution is added, the larger the particle size of the strontium titanate particles. The higher the rate at which the alkaline aqueous solution is added, the smaller the particle size of the strontium titanate particles. The rate at which the alkaline aqueous solution is added is, for example, 0.001 eq/h or more and 1.2 eq/h or less, and preferably 0.002 eq/h or more and 1.1 eq/h or less relative to the prepared raw materials.

After the alkaline aqueous solution is added, the acid treatment is performed to remove the unreacted strontium source. The acid treatment involves, for example, adjusting the pH of the reaction liquid to 2.5 to 7.0, preferably 4.5 to 6.0 by using hydrochloric acid.

After the acid treatment, the reaction liquid is subjected to solid-liquid separation, and the solid matter is dried to provide strontium titanate particles.

The water content of the strontium titanate particles is controlled by regulating the conditions for drying the solid matter.

In the case where the surface of the strontium titanate particles is hydrophobized, the water content may be controlled by regulating the drying conditions after hydrophobization.

In suitable drying conditions to control the water content, for example, the drying temperature is 90° C. or higher and 300° C. or lower (preferably 100° C. or higher and 150° C. or lower), and the drying time is 1 hour or longer and 15 hours or shorter (preferably 5 hours or longer and 10 hours or shorter).

Hydrophobization

Surface hydrophobization of strontium titanate particles involves, for example, preparing a treatment liquid which is a mixture of a silicon-containing organic compound, which is a hydrophobizing agent, and a solvent, mixing the strontium titanate particles and the treatment liquid under stirring, and further continuing stirring.

After the surface treatment, the mixture is dried to remove the solvent in the treatment liquid.

Examples of the silicon-containing organic compound, which is a hydrophobizing agent, include alkoxysilane compounds, silazane compounds, and silicone oils.

Examples of alkoxysilane compounds, which are hydrophobizing agents, include tetramethoxysilane and tetraethoxysilane; methyltrimethoxysilane, ethyltrimethoxysilane, propyltrimethoxysilane, butyltrimethoxysilane, hexyltrimethoxysilane, n-octyltrimethoxysilane, decyltrimethoxysilane, dodecyltrimethoxysilane, vinyltriethoxysilane, methyltriethoxysilane, ethyltriethoxysilane, butyltriethoxysilane, hexyltriethoxysilane, decyltriethoxysilane, dodecyltriethoxysilane, phenyltrimethoxysilane, o-methylphenyl trimethoxysilane, p-methylphenyl trimethoxysilane, phenyltriethoxysilane, and benzyltriethoxysilane; dimethyldimethoxysilane, dimethyldiethoxysilane, methylvinyldimethoxysilane, methylvinyldiethoxysilane, diphenyldimethoxysilane, and diphenyldiethoxysilane; and trimethylmethoxysilane and trimethylethoxysilane.

Examples of silazane compounds, which are hydrophobizing agents, include dimethyl disilazane, trimethyl disilazane, tetramethyl disilazane, pentamethyl disilazane, and hexamethyl disilazane.

Examples of silicone oils, which are hydrophobizing agents, include silicone oils, such as dimethylpolysiloxane, diphenylpolysiloxane, and phenylmethylpolysiloxane; and reactive silicone oils, such as amino-modified polysiloxane, epoxy-modified polysiloxane, carboxyl-modified polysiloxane, carbinol-modified polysiloxane, fluorine-modified polysiloxane, methacrylic-modified polysiloxane, mercapto-modified polysiloxane, and phenol-modified polysiloxane.

Among these, the hydrophobizing agent is preferably an alkoxysilane compound to reduce susceptibility to differences in charging environment and improve fluidity, and more preferably butyltrimethoxysilane to improve fluidity.

The solvent used to prepare the treatment liquid may be an alcohol (e.g., methanol, ethanol, propanol, or butanol) when the silicon-containing organic compound is an alkoxysilane compound or a silazane compound. The solvent may be a hydrocarbon (e.g., benzene, toluene, normal hexane, or normal heptane) when the silicon-containing organic compound is a silicone oil.

The concentration of the silicon-containing organic compound in the treatment liquid is preferably 1 mass % or more and 50 mass % or less, more preferably 5 mass % or more and 40 mass % or less, and still more preferably 10 mass % or more and 30 mass % or less.

The amount of the silicon-containing organic compound used in hydrophobization is, as described above, preferably 1 mass % or more and 50 mass % or less, more preferably 5 mass % or more and 40 mass % or less, still more preferably 5 mass % or more and 30 mass % or less, and yet still more preferably 10 mass % or more and 25 mass % or less relative to the mass of the strontium titanate particles.

The strontium titanate particles having the hydrophobized surface are produced accordingly.

Toner

The electrostatic charge image developer according to this exemplary embodiment contains a toner.

The toner used in this exemplary embodiment contains toner particles (also referred to as "toner base particles") and, if necessary, external additives.

Some of the strontium titanate particles also function as an external additive for the toner.

The toner particles contain, for example, a binder resin and, if necessary, a coloring agent, a release agent, and other additives, and preferably contain a binder resin and a release agent.

In this exemplary embodiment, examples of the toner particles include, but are not limited to, toner particles of yellow toner, magenta toner, cyan toner, black toner, and the like; and white toner particles, transparent toner particles, and photoluminescent toner particles.

Binder Resin

Examples of the binder resin include vinyl resins composed of a homopolymer of a monomer or a copolymer of two or more monomers of, for example, styrenes (e.g., styrene, p-chlorostyrene, α-methylstyrene), (meth)acrylic acid esters (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate), ethylenically unsaturated nitriles (e.g., acrylonitrile, methacrylonitrile), vinyl ethers (e.g., vinyl methyl ether, vinyl isobutyl ether), vinyl ketones (e.g., vinyl methyl ketone, vinyl ethyl ketone, vinyl isopropenyl ketone), and olefins (e.g., ethylene, propylene, butadiene).

Examples of the binder resin include non-vinyl resins, such as epoxy resins, polyester resins, polyurethane resins, polyamide resins, cellulose resins, polyether resins, and modified rosins; and mixtures of these non-vinyl resins and the above vinyl resins, and graft polymers obtained by polymerization of a vinyl monomer in the presence of these non-vinyl resins.

These binder resins may be used alone or in combination of two or more.

The binder resin may be a polyester resin. Examples of the polyester resin include polycondensation polymers of a polycarboxylic acid and a polyhydric alcohol.

Examples of the polycarboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, naphthalene dicarboxylic acid), anhydrides thereof, and lower (e.g., 1 or more and 5 or less carbon atoms) alkyl esters thereof. Among these, the polycarboxylic acid is preferably, for example, an aromatic dicarboxylic acid. The polycarboxylic acid may be a combination of a dicarboxylic acid and a trivalent or higher valent carboxylic acid having a cross-linked structure or branched structure. Examples of the trivalent or higher valent carboxylic acid include trimellitic acid, pyromellitic acid, anhydrides thereof, and lower (e.g., 1 or more and 5 or less carbon atoms) alkyl esters thereof.

The polycarboxylic acid may be used alone or in combination of two or more.

Examples of the polyhydric alcohol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexane dimethanol, hydrogenated bisphenol A), aromatic diols (e.g., an ethylene oxide adduct of bisphenol A, and a propylene oxide adduct of bisphenol A). Among these, the polyhydric alcohol is preferably, for example, an aliphatic diol or an alicyclic diol, and more preferably an aliphatic diol.

The polyhydric alcohol may be a combination of a diol and a trihydric or higher polyhydric alcohol having a cross-linked structure or branched structure. Examples of the trihydric or higher polyhydric alcohol include glycerol, trimethylolpropane, and pentaerythritol.

The polyhydric alcohol may be used alone or in combination of two or more.

The glass transition temperature (Tg) of the polyester resin is preferably 50° C. or higher and 80° C. or lower, and more preferably 50° C. or higher and 65° C. or lower.

The glass transition temperature is determined from the DSC curve obtained by differential scanning calorimetry (DSC) and, more specifically, determined in accordance with "extrapolated glass transition onset temperature" described in the method for determining the glass transition temperature in JIS K 7121-1987 "Testing Methods for Transition Temperatures of Plastics".

The weight-average molecular weight (Mw) of the polyester resin is preferably 5,000 or more and 1,000,000 or less, and more preferably 7,000 or more and 500,000 or less. The number-average molecular weight (Mn) of the polyester resin is preferably 2,000 or more and 100,000 or less. The molecular weight distribution Mw/Mn of the polyester resin is preferably 1.5 or more and 100 or less, and more preferably 2 or more and 60 or less.

The weight-average molecular weight and the number-average molecular weight of the polyester resin is determined by gel permeation chromatography (GPC). The determination of the molecular weight by GPC is carried out using HLC-8120GPC, which is a GPC available from Tosoh Corporation and used as a measurement system, TSKgel SuperHM-M (15 cm), which is a column available from Tosoh Corporation, and a THF solvent. The weight-average molecular weight and the number-average molecular weight are calculated from the molecular weight calibration curve created on the basis of the obtained measurement results by using a monodisperse polystyrene standard.

The polyester resin is produced by using a known production method. Specifically, the polyester resin is produced by using, for example, a method involving causing reaction at a polymerization temperature of 180° C. or higher and 230° C. or lower in a reaction system, if necessary, under reduced pressure while water and alcohol generated during condensation are removed.

If the monomers serving as raw materials do not dissolve or are not compatible with each other at a reaction temperature, a solvent with a high boiling point may be added as a solubilizer to cause dissolution. In this case, the polycondensation reaction is carried out while the solubilizer is distilled off. If a monomer with poor compatibility is present, the monomer with poor compatibility is previously subjected to condensation with an acid or alcohol that is to undergo polycondensation with the monomer, and the condensate is then subjected to polycondensation with a main component.

The amount of the binder resin is preferably 40 mass % or more and 95 mass % or less, more preferably 50 mass % or more and 90 mass % or less, and still more preferably 60 mass % or more and 85 mass % or less relative to the total mass of the toner particles.

The amount of the binder resin when the toner particles are white toner particles is preferably 30 mass % or more and 85 mass % or less, and more preferably 40 mass % or more and 60 mass % or less relative to the total mass of the white toner particles.

Coloring Agent

Examples of the coloring agent include pigments, such as carbon black, chrome yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, malachite green oxalate, titanium oxide, zinc oxide, calcium carbonate, basic lead carbonate, zinc sulfide-barium sulfate mixture, zinc sulfide, silicon dioxide, and aluminum oxide; and dyes, such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

In the case where the toner particles are white toner particles, the coloring agent may be a white pigment.

The white pigment is preferably titanium oxide or zinc oxide, and more preferably titanium oxide.

The coloring agent may be used alone or in combination of two or more.

The coloring agent may be a coloring agent with the surface treated if necessary and may be used in combination with a dispersant.

The amount of the coloring agent is preferably 1 mass % or more and 30 mass % or less, and more preferably 3 mass % or more and 15 mass % or less relative to the total mass of the toner particles.

The amount of the white pigment in the case where the toner particles are white toner particles is preferably 15 mass % or more and 70 mass % or less, and more preferably 20 mass % or more and 60 mass % or less relative to the total mass of the white toner particles.

Release Agent

Examples of the release agent include hydrocarbon waxes; natural waxes, such as carnauba wax, rice wax, and candelilla wax; synthetic or mineral and petroleum waxes, such as montan wax; and ester waxes, such as waxes of fatty acid esters and montanic acid esters. The release agent is not limited to these.

The melting temperature of the release agent is preferably 50° C. or higher and 110° C. or lower, and more preferably 60° C. or higher and 100° C. or lower.

The melting temperature is determined from the DSC curve obtained by differential scanning calorimetry (DSC) in accordance with "melting peak temperature" described in the method for determining the melting temperature in JIS K 7121-1987 "Testing Methods for Transition Temperatures of Plastics".

The amount of the release agent is preferably 1 mass % or more and 20 mass % or less, and more preferably 5 mass % or more and 15 mass % or less relative to the total mass of the toner particles.

Other Additives

Examples of other additives include known additives, such as magnetic substances, charge control agents, and inorganic powders. These additives are internal additives and contained in the toner particles.

Properties of Toner Particles

The toner particles may be toner particles having a single-layer structure, or may be toner particles having so-called a core-shell structure including a core part (core particle) and a coating layer (shell layer) covering the core part. The toner particles having a core-shell structure include, for example, a core part containing a binder resin and, if necessary, a coloring agent, a release agent, and the like; and a coating layer containing a binder resin.

The volume-average particle size (D50v) of the toner is preferably 2 μm or more and 10 μm or less, and more preferably 4 μm or more and 8 μm or less.

The volume-average particle size of the toner is measured by using Coulter Multisizer II (available from Beckman Coulter, Inc.) and the electrolyte ISOTON-II (available from Beckman Coulter, Inc.).

Before measurement, 0.5 mg or more and 50 mg or less of a test sample is added to 2 ml of a 5 mass % aqueous solution of a surfactant (e.g., sodium alkylbenzene sulfonate) serving as a dispersant. The mixture is added to 100 ml or more and 150 ml or less of the electrolyte.

The electrolyte in which the sample is suspended is subjected to a dispersion treatment with an ultrasonic disperser for 1 minute, and the particle size of particles having a particle size in the range of 2 μm or more and 60 μm or less is measured by Coulter Multisizer II with an aperture having a diameter of 100 μm. The number of particles sampled is 50,000.

The volume-based cumulative distribution of the measured particle size is drawn from the smaller particle size side, and the particle size at cumulative 50% is defined as a volume-average particle size D50v.

The average circularity of the toner particles in this exemplary embodiment is not limited but preferably 0.91 or more and 0.98 or less, more preferably 0.94 or more and 0.98 or less, and still more preferably 0.95 or more and 0.97 or less to improve the ability to clean the toner from the image holding body.

The strontium titanate particles having a small particle size and a round shape as described above are not unevenly dispersed on the surface of the toner particles. The same applies to the toner particles having different shapes as described above. The strontium titanate particles are not locally present in fine recesses, but substantially uniformly dispersed on the surface of the toner particles.

The circularity of a toner particle in this exemplary embodiment is (the circumference of a circle having the same area as the projected particle image)/(the circumference of the projected particle image). The average circularity of the toner particles is the circularity at cumulative 50% from the smaller circularity side in the circularity distribution. The average circularity of the toner particles is determined by analyzing at least 3,000 toner particles with a flow-type particle image analyzer.

In the case where, for example, the toner particles are produced by using the aggregation-coalescence method, the average circularity of the toner particles may be controlled by regulating the stirring speed of the dispersion, the temperature of the dispersion, or the retention time in the fusion-coalescence step.

External Additives

The toner used in this exemplary embodiment may contain particles other than the strontium titanate particles as an external additive.

Examples of other particles include inorganic particles other than strontium titanate particles.

Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surface of the inorganic particles serving as an external additive may be hydrophobized. Hydrophobization is performed by, for example, immersing the inorganic particles in a hydrophobizing agent. Examples of the hydrophobizing agent include, but are not limited to, a silane coupling agent, a silicone oil, a titanate coupling agent, and an aluminum coupling agent. These hydrophobizing agents may be used alone or in combination of two or more.

The amount of the hydrophobizing agent may be 1 part by mass or more and 10 parts by mass or less per 100 parts by mass of the inorganic particles.

Examples of other particles also include resin particles (resin particles formed of, for example, polystyrene, polymethyl methacrylate, and melamine resin), and cleaning active agents (e.g., particles formed of fluorocarbon polymers).

In the case where the electrostatic charge image developer according to this exemplary embodiment contains particles other than strontium titanate particles as an external additive, the amount of the strontium titanate particles is preferably 20 mass % or more and 100 mass % or less, more preferably 30 mass % or more and 100 mass % or less, and still more preferably 40 mass % or more and 80 mass % or less relative to the total mass of the strontium titanate particles and external additives other than the strontium titanate particles in the electrostatic charge image developer.

Method for Producing Toner

Next, a method for producing a toner will be described below.

The toner according to this exemplary embodiment may be obtained by externally adding external additives including strontium titanate particles to toner particles after production of the toner particles.

The toner particles may be produced by using any one of dry methods (e.g., kneading-grinding method) and wet methods (e.g., aggregation-coalescence method, suspension-polymerization method, and dissolution-suspension method). The method is not limited to these methods, and a known method is employed. Among these methods, the toner particles are preferably produced by using an aggregation-coalescence method.

Specifically, for example, when the toner particles are produced by using an aggregation-coalescence method, the toner particles are produced through the following steps: a step (resin particle dispersion preparing step) of preparing a resin particle dispersion in which resin particles serving as a binder resin are dispersed; a step (aggregated particle forming step) of aggregating the resin particles (and other particles if necessary) in the resin particle dispersion (in a dispersion obtained by mixing the resin particle dispersion with other particle dispersion if necessary) to form aggregated particles; and a step (fusion-coalescence step) of heating an aggregated particle dispersion in which the aggregated particles are dispersed, to cause fusion and coalescence of the aggregated particles and thus to form toner particles.

Each step will be described below in detail.

The following description provides a method for producing toner particles containing a coloring agent and a release agent, but the coloring agent and the release agent are used if necessary. It is understood that additives other than the coloring agent and the release agent may be used.

Resin Particle Dispersion Preparing Step

In addition to a resin particle dispersion in which resin particles serving as a binder resin are dispersed, for example, a coloring agent particle dispersion in which coloring agent particles are dispersed, and a release agent particle dispersion in which release agent particles are dispersed are prepared.

The resin particle dispersion is prepared by, for example, dispersing resin particles in a dispersion medium through use of a surfactant.

Examples of the dispersion medium used in the resin particle dispersion include aqueous media.

Examples of aqueous media include water such as distilled water and ion exchange water and alcohols. These aqueous media may be used alone or in combination of two or more.

Examples of the surfactant include anionic surfactants, such as sulfate-based surfactants, sulfonate-based surfactants, phosphate-based surfactants, and soap-based surfactants; cationic surfactants, such as amine salt-based surfactants and quaternary ammonium salt-based surfactants; and nonionic surfactants, such as polyethylene glycol-based surfactants, alkylphenol ethylene oxide adduct-based surfactants, and polyhydric alcohol-based surfactants. Among these surfactants, in particular, anionic surfactants and cationic surfactants may be used. A nonionic surfactant may be used in combination with an anionic surfactant or a cationic surfactant.

The surfactant may be used alone or in combination of two or more.

Examples of a method for dispersing resin particles in a dispersion medium to prepare the resin particle dispersion include ordinary dispersion methods using a rotary shear homogenizer, a ball mill having media, a sand mill, and Dyno-Mill. Depending on the type of resin particles, the resin particles may be dispersed in the dispersion medium by a phase-inversion emulsification method. The phase-inversion emulsification method is a method for dispersing a resin in the form of particles in an aqueous medium. This method involves dissolving a target resin in a hydrophobic organic solvent capable of dissolving the resin; adding a base to the organic continuous phase (O phase) to cause neutralization; and then adding an aqueous medium (W phase) to cause phase inversion from W/O to O/W.

The volume-average particle size of the resin particles dispersed in the resin particle dispersion is preferably, for example, 0.01 μm or more and 1 μm or less, more preferably 0.08 μm or more and 0.8 μm or less, and still more preferably 0.1 μm or more and 0.6 μm or less.

The volume-average particle size of the resin particles is determined as follows: drawing the volume-based cumulative distribution in divided particle size ranges (channels) from the smaller particle size side on the basis of the particle size distribution obtained by measurement with a laser diffraction particle size distribution measuring device (e.g., LA-700, available from Horiba Ltd.); and defining the particle size at cumulative 50% relative to all particles as a volume-average particle size D50v. The volume-average particle size of particles in other dispersions is determined similarly.

The amount of the resin particles in the resin particle dispersion is preferably 5 mass % or more and 50 mass % or less, and more preferably 10 mass % or more and 40 mass % or less.

Similarly to the resin particle dispersion, for example, the coloring agent particle dispersion and the release agent particle dispersion are also prepared. Specifically, the description of the volume-average particle size of the particles, the dispersion medium, the dispersion method, and the amount of the particles for the resin particle dispersion is applied to the coloring agent particles dispersed in the coloring agent particle dispersion and the release agent particles dispersed in the release agent particle dispersion.

Aggregated Particle Forming Step

Next, the resin particle dispersion is mixed with the coloring agent particle dispersion and the release agent particle dispersion. The resin particles, the coloring agent particles, and the release agent particles cause hetero-aggregation in the mixture dispersion to form aggregated particles having a size close to the intended toner particle size and containing the resin particles, the coloring agent particles, and the release agent particles.

Specifically, the aggregated particles are formed, for example, as follows: adding a flocculant to the mixture dispersion and adjusting the pH of the mixture dispersion to the acid side (e.g., pH 2 or higher and pH 5 or lower), and if necessary, adding a dispersion stabilizer; and then heating the mixture dispersion to a temperature close to the glass transition temperature of the resin particles (specifically, heating to, for example, the glass transition temperature of the resin particles minus 30° C. or higher and the glass transition temperature minus 10° C. or lower) to cause aggregation of the particles dispersed in the mixture dispersion.

The aggregated particle forming step may involve, for example, adding a flocculant to the mixture dispersion at room temperature (e.g., 25° C.) under stirring with a rotary shear homogenizer and adjusting the pH of the mixture dispersion to the acid side (e.g., pH 2 or higher and pH 5 or lower), and heating the mixture dispersion after addition of a dispersion stabilizer if necessary.

Examples of the flocculant include surfactants having polarity opposite to the polarity of the surfactant contained in the mixture dispersion, inorganic metal salts, and divalent or higher valent metal complexes. The use of a metal complex as a flocculant may reduce the amount of the surfactant used and improves charging characteristics.

The flocculant may be used in combination with an additive that forms a complex or a similar bond with metal ions of the flocculant, if necessary. The additive may be a chelating agent.

Examples of inorganic metal salts include metal salts, such as calcium chloride, calcium nitrate, barium chloride, magnesium chloride, zinc chloride, aluminum chloride, and aluminum sulfate; and inorganic metal salt polymers, such as polyaluminum chloride, polyaluminum hydroxide, and calcium polysulfide.

The chelating agent may be a water-soluble chelating agent. Examples of the chelating agent include oxycarboxylic acids, such as tartaric acid, citric acid, and gluconic acid; and aminocarboxylic acids, such as iminodiacetic acid (IDA), nitrilotriacetic acid (NTA), and ethylenediaminetetraacetic acid (EDTA).

The amount of the chelating agent added is preferably 0.01 parts by mass or more and 5.0 parts by mass or less, and more preferably 0.1 parts by mass or more and 3.0 parts by mass or less per 100 parts by mass of the resin particles.

Fusion-Coalescence Step

Next, the aggregated particle dispersion in which the aggregated particles are dispersed is heated to, for example, a temperature not lower than the glass transition temperature of the resin particles (e.g., a temperature not lower than a temperature higher than the glass transition temperature of the resin particles by 10° C. to 30° C.) to cause fusion and coalescence of the aggregated particles and thus to form toner particles.

The toner particles are produced through the above-described steps.

The toner particles may be produced through the following steps: a step of preparing an aggregated particle dispersion in which aggregated particles are dispersed, and then mixing the aggregated particle dispersion and a resin particle dispersion in which resin particles are dispersed, to cause aggregation such that the resin particles are attached to the surface of the aggregated particles and thus to form secondary aggregated particles; and a step of heating a secondary aggregated particle dispersion in which the secondary aggregated particles are dispersed, to cause fusion and coalescence of the secondary aggregated particles and thus to form toner particles having a core-shell structure.

After completion of the fusion-coalescence step, the toner particles formed in the dispersion are subjected to a known washing step, a known solid-liquid separation step, and a known drying step to provide dry toner particles. The washing step may involve sufficient displacement washing with ion exchange water in view of charging characteristics. The solid-liquid separation step may involve, for example, suction filtration or pressure filtration in view of productivity. The drying step may involve, for example, freeze drying, flush drying, fluidized bed drying, or vibratory fluidized bed drying in view of productivity.

The toner according to this exemplary embodiment may be produced by, for example, adding external additives including strontium titanate particles to the obtained dry toner particles and mixing them. Mixing may be performed with, for example, a V-blender, a Henschel mixer, or a Lodige mixer. If necessary, coarse toner particles may be removed with, for example, a vibratory screening machine, or a wind-power screening machine.

Image Forming Apparatus and Image Forming Method

An image forming apparatus and an image forming method according to this exemplary embodiment will be described.

The image forming apparatus according to this exemplary embodiment includes an image holding body; a charging unit that charges the surface of the image holding body; an electrostatic charge image forming unit that forms an electrostatic charge image on the charged surface of the image holding body; a developing unit that contains an electrostatic charge image developer and develops the electrostatic charge image on the surface of the image holding body by using the electrostatic charge image developer to form a toner image; a transfer unit that transfers the toner image on the surface of the image holding body onto the surface of a recording medium; and a fixing unit that fixes the toner image that has been transferred onto the surface of the recording medium. The electrostatic charge image developer according to this exemplary embodiment is used as an electrostatic charge image developer.

An image forming method (an image forming method according to this exemplary embodiment) performed in the image forming apparatus according to this exemplary embodiment includes a charging step of charging the surface of the image holding body; an electrostatic charge image forming step of forming an electrostatic charge image on the charged surface of the image holding body; a developing step of developing the electrostatic charge image on the surface of the image holding body by using the electrostatic charge image developer according to this exemplary embodiment to form a toner image; a transferring step of transferring the toner image on the surface of the image holding body onto the surface of a recording medium; and a fixing step of fixing the toner image that has been transferred onto the surface of the recording medium.

The image forming apparatus according to this exemplary embodiment may be a known image forming apparatus, such as a direct transfer-type apparatus in which a toner image formed on the surface of an image holding body is directly transferred onto a recording medium; an intermediate transfer-type apparatus in which a toner image formed on the surface of an image holding body is firstly transferred onto the surface of an intermediate transfer body, and the toner image, which has been transferred onto the surface of the intermediate transfer medium, is secondly transferred onto the surface of a recording medium; an apparatus including a cleaning unit that cleans the surface of an image holding body before charging after transfer of a toner image; and an apparatus including a charge eliminating unit that eliminates charges by irradiating the surface of an image holding body with charge eliminating light before charging after transfer of a toner image.

In the case where the image forming apparatus according to this exemplary embodiment is an intermediate transfer-type apparatus, the transfer unit includes, for example, an intermediate transfer body having the surface onto which a toner image is transferred, a first transfer unit that firstly transfers the toner image on the surface of the image holding body onto the surface of the intermediate transfer body, and a second transfer unit that secondly transfers the toner image, which has been transferred onto the surface of the intermediate transfer body, onto the surface of a recording medium.

In the image forming apparatus according to this exemplary embodiment, a section including the developing unit may have a cartridge structure (process cartridge) that is attachable to and detachable from the image forming apparatus. The process cartridge may be a process cartridge including a developing unit that contains the electrostatic charge image developer according to this exemplary embodiment.

An example of the image forming apparatus according to this exemplary embodiment will be described below, but the image forming apparatus is not limited to this example. In the following description, the main parts illustrated in the figure are described, and the description of other parts is omitted.

FIG. 1 is a schematic view of the image forming apparatus according to this exemplary embodiment.

The image forming apparatus illustrated in FIG. 1 includes first to fourth image forming units 10Y, 10M, 10C, and 10K (image forming parts), which respectively output yellow (Y), magenta (M), cyan (C), and black (K) color images based on color-separated image data. The image forming units (hereinafter may also be referred to simply as "units") 10Y, 10M, 10C, and 10K are spaced apart from each other at predetermined intervals in the horizontal direction. The units 10Y, 10M, 10C, and 10K may be process cartridges that are attachable to and detachable from the image forming apparatus.

An intermediate transfer belt (an example of the intermediate transfer body) 20 is located above and in upper parts of the units 10Y, 10M, 10C, and 10K. The intermediate transfer belt 20 extends so as to pass through the units 10Y, 10M, 10C, and 10K. The intermediate transfer belt 20 is wound around a drive roller 22 and a support roller 24, which are in contact with the inner surface of the intermediate transfer belt 20, and runs in the direction from the first unit 10Y toward the fourth unit 10K. A force is applied to the support roller 24 in a direction away from the drive roller 22 by means of a spring or the like (not illustrated), so that tension is applied to the intermediate transfer belt 20 wound around both the support roller 24 and the drive roller 22. An intermediate transfer belt cleaning device 30 is disposed adjacent to the image holding surface of the intermediate transfer belt 20 so as to face the drive roller 22.

Yellow toner, magenta toner, cyan toner, and black toner in the respective toner cartridges 8Y, 8M, 8C, and 8K are supplied to the respective developing devices (examples of developing units) 4Y, 4M, 4C, and 4K of the units 10Y, 10M, 10C, and 10K.

Since the first to fourth units 10Y, 10M, 10C, and 10K have the same structure and operate in the same manner, the first unit 10Y disposed upstream in the running direction of the intermediate transfer belt to form a yellow image will be representatively described.

The first unit 10Y has a photoreceptor 1Y that functions as an image holding body. The photoreceptor 1Y is surrounded by, in sequence, a charging roller (an example of the charging unit) 2Y that charges the surface of the photoreceptor 1Y to a predetermined potential, an exposure device (an example of the electrostatic charge image forming unit) 3 that exposes the charged surface to a laser beam 3Y based on a color-separated image signal to form an electrostatic charge image, a developing device (an example of the developing unit) 4Y that supplies charged toner to the electrostatic charge image to develop the electrostatic charge image, a first transfer roller (an example of the first transfer unit) 5Y that transfers the developed toner image onto the intermediate transfer belt 20, and a photoreceptor cleaning device (an example of the image holding body cleaning unit) 6Y that removes residual toner from the surface of the photoreceptor 1Y after the first transfer.

The first transfer roller 5Y is disposed on the inner side of the intermediate transfer belt 20 so as to face the photoreceptor 1Y. The first transfer rollers 5Y, 5M, 5C, and 5K in the units are connected to the respective bias power supplies (not illustrated) that apply a first transfer bias. The transfer bias applied by each bias power supply to the corresponding first transfer roller changes under the control of a controller (not illustrated).

The operation of the first unit 10Y in forming a yellow image will be described below.

Before operation, the charging roller 2Y charges the surface of the photoreceptor 1Y to a potential of from −600 V to −800 V.

The photoreceptor 1Y includes a conductive substrate (e.g., with a volume resistivity of $1\times10^{-6}$ Ω·cm or less at 20° C.) and a photosensitive layer stacked on the substrate. The photosensitive layer normally has high resistance (comparable to the resistance of common resins), but irradiation with a laser beam changes the specific resistance of a region of the photosensitive layer irradiated with the laser beam. For this, the charged surface of the photoreceptor 1Y is irradiated with the laser beam 3Y from the exposure device 3 in accordance with yellow image data sent from the controller (not illustrated). As a result, an electrostatic charge image with a yellow image pattern is formed on the surface of the photoreceptor 1Y.

The electrostatic charge image is an image formed on the surface of the photoreceptor 1Y by means of charging. Specifically, the electrostatic charge image is so-called a negative latent image formed such that the specific resistance of a region of the photosensitive layer irradiated with the laser beam 3Y drops to cause flow of charges on the surface of the photoreceptor 1Y while charges in a region that is not irradiated with the laser beam 3Y remain.

The electrostatic charge image formed on the photoreceptor 1Y rotates up to a predetermined developing position as the photoreceptor 1Y runs. The electrostatic charge image on the photoreceptor 1Y is developed and visualized by the developing device 4Y to form a toner image at this developing position.

The developing device 4Y contains, for example, an electrostatic charge image developer including at least yellow toner and a carrier. The yellow toner is triboelectrically charged upon being stirred inside the developing device 4Y so as to have charges with the same polarity (negative polarity) as charges on the photoreceptor 1Y. The yellow toner is held on a developer roller (an example of a developer holding body). As the surface of the photoreceptor 1Y passes through the developing device 4Y, the yellow toner is electrostatically attached to a latent image part on the surface of the photoreceptor 1Y from which charges have been eliminated, whereby the latent image is developed with the yellow toner. The photoreceptor 1Y having the yellow toner image formed thereon subsequently runs at a predetermined rate, and the toner image developed on the photoreceptor 1Y is transported to a predetermined first transfer position.

When the yellow toner image on the photoreceptor 1Y is transported to the first transfer position, a first transfer bias is applied to the first transfer roller 5Y, an electrostatic force from the photoreceptor 1Y toward the first transfer roller 5Y acts on the toner image, and the toner image on the photoreceptor 1Y is transferred onto the intermediate transfer belt 20. The transfer bias applied at this time has polarity (+) opposite to the polarity (−) of the toner. The transfer bias is controlled at, for example, +10 μA in the first unit 10Y by the controller (not illustrated). The toner remaining on the photoreceptor 1Y is removed and collected by the photoreceptor cleaning device 6Y.

The first transfer biases applied to the first transfer rollers 5M, 5C, and 5K in the second unit 10M and the subsequent units are also controlled in the same manner as in the first unit.

Accordingly, the intermediate transfer belt 20 onto which the yellow toner image has been transferred in the first unit 10Y is transported through the second to fourth units 10M, 10C, and 10K, and the toner images of respective colors are multiply transferred in a superimposed manner.

The intermediate transfer belt 20 onto which the four color toner images have been multiply transferred through the first to fourth units reaches a second transfer section. The second transfer section includes the intermediate transfer belt 20, the support roller 24 in contact with the inner surface of the intermediate transfer belt, and a second transfer roller (an example of the second transfer unit) 26 disposed adjacent to the image holding surface of the intermediate transfer belt 20. A sheet of recording paper (an example of the recording medium) P is fed to a gap between the second transfer roller 26 and the intermediate transfer belt 20 through a feeding mechanism at a predetermined timing, and a second transfer bias is applied to the support roller 24. The transfer bias applied at this time has the same polarity (−) as the polarity (−) of the toner. An electrostatic force from the intermediate transfer belt 20 toward the sheet of recording paper P acts on the toner image, whereby the toner image on the intermediate transfer belt 20 is transferred onto the sheet of recording paper P. The second transfer bias in this case is determined on the basis of the resistance detected by a resistance detector (not illustrated) that detects the resistance of the second transfer section. The voltage for the second transfer bias is controlled.

The sheet of recording paper P onto which the toner image has been transferred is conveyed to a pressure contact part (nip part) between a pair of fixing rollers in a fixing device (an example of the fixing unit) 28. The toner image is thus fixed to the sheet of recording paper P to form a fixed image. The sheet of recording paper P to which the color image has been fixed is discharged to a discharge part, and a series of color image forming operations are completed.

Examples of the recording paper P onto which a toner image is transferred include plain paper used in electrophotographic copiers, printers, and the like. Examples of the recording medium include OHP sheets, in addition to the recording paper P. To improve the smoothness of the image surface after fixation, the recording paper P may have a smooth surface and may be, for example, coated paper obtained by coating the surface of plain paper with resin or the like, art paper for printing, or the like.

Process Cartridge, Developer Cartridge

The process cartridge according to this exemplary embodiment includes a developing unit that contains the electrostatic charge image developer according to this exemplary embodiment and develops an electrostatic charge image on the surface of an image holding body by using the electrostatic charge image developer to form a toner image. The process cartridge according to this exemplary embodiment is attachable to and detachable from an image forming apparatus.

The process cartridge according to this exemplary embodiment may include a developing unit, and if necessary, at least one selected from other units, such as an image holding body, a charging unit, an electrostatic charge image forming unit, and a transfer unit.

An example of the process cartridge according to this exemplary embodiment will be described below, but the process cartridge is not limited to this example. In the following description, the main parts illustrated in the figure are described, and the description of other parts is omitted.

Figure 2:
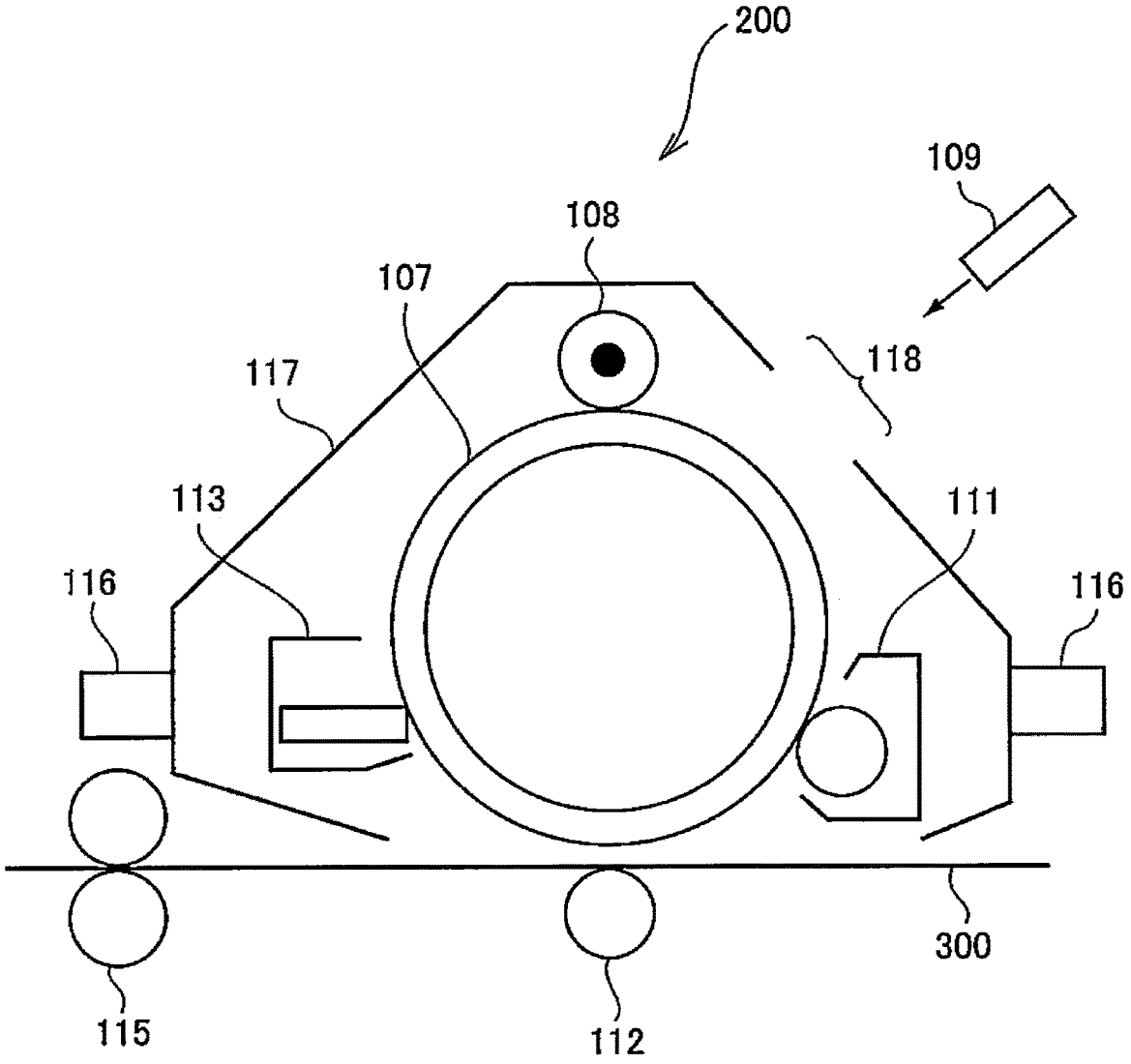
FIG. 2 is a schematic view of a process cartridge according to an exemplary embodiment.

FIG. 2 is a schematic view of an example of the process cartridge according to this exemplary embodiment.

A process cartridge 200 illustrated in FIG. 2 is formed as, for example, a cartridge in which a photoreceptor 107 (an example of the image holding body), a charging roller 108 (an example of the charging unit) on the periphery of the photoreceptor 107, a developing device 111 (an example of the developing unit), and a photoreceptor cleaning device 113 (an example of the cleaning unit) are integrally combined and held together by a housing 117 including installation rails 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a sheet of recording paper (an example of the recording medium).

Next, a developer cartridge according to this exemplary embodiment will be described.

The developer cartridge according to this exemplary embodiment contains at least the electrostatic charge image developer according to this exemplary embodiment.

The developer cartridge according to this exemplary embodiment is, for example, attachable to and detachable from an image forming apparatus including a developing unit. The developer cartridge contains the electrostatic charge image developer according to this exemplary embodiment as a developer to be supplied to the developing unit.

EXAMPLES

Examples of the present disclosure will be described below, but the present disclosure is not limited to the following Examples. In the following description, the units "part" and "%" are all on the mass basis, unless otherwise specified.

Preparation of Porous Magnetic Particles (Magnetic Particles (1))

First, 74 parts of $Fe_2O_3$, 4 parts of $Mg(OH)_2$, and 21 parts of $MnO_2$ are mixed, and the mixture is calcined in a rotary kiln under the conditions of temperature 950° C./5 hours (first calcination). The obtained calcination product is ground in a wet ball mill for 7 hours to provide particles having an average particle size of 3.0 μm. The particles are calcined in a rotary kiln under the conditions of temperature 950° C./6 hours (second calcination). The obtained calcination product is ground in a wet ball mill for 3 hours into an average particle size of 2.0 μm. Subsequently, 2.0 parts by mass of polyvinyl alcohol is added as a binder per 100 parts by mass of calcined ferrite, followed by granulation in a spray dryer. The obtained particles are then heated to 750° C. in an atmosphere in a rotary electric furnace for 2 hours to remove organic compounds, such as a binder resin and additives. The obtained particles are fired under the conditions of temperature 1,050° C./5 hours in an electric furnace. The obtained fired product is subjected to disintegration and classification to provide magnetic particles (1) having a volume-average particle size of 32 μm.

Preparation of Resin-Filled Core Particles (1)

A filling resin 1 (solution) is prepared by mixing 100 parts by mass (in terms of silicone resin solids content) of a silicone resin (SR-2411 available from Dow Corning Toray Co., Ltd., resin solids content 20 mass %), which is a filling resin, and 5 parts by mass of γ-aminopropyltriethoxysilane. In a mixing and stirring machine, 100 parts by mass of the magnetic particles 1 are placed and heated to a temperature of 50° C. under reduced pressure. To 100 parts by mass of the magnetic particles 1, 7.0 parts by mass (in terms of filling resin component) of the filling resin 1 solution is added dropwise over 2 hours. The mixture is further stirred at a temperature of 50° C. for 1 hour. The mixture is then heated to a temperature of 80° C. to completely remove the solvent component. The obtained sample is transferred to a mixer (drum mixer UD-AT model available from Sugiyama Heavy Industrial Co., Ltd.) having spiral blades in a rotary mixing vessel and processed at a temperature of 200° C. in a nitrogen atmosphere for 2 hours. The processed sample is classified through a mesh with a mesh size of 70 μm to provide resin-filled core particles (1).

Preparation of Ferrite Core Particles (2)

First, 74 parts of $Fe_2O_3$, 4 parts of $Mg(OH)_2$, and 21 parts of $MnO_2$ are mixed, and the mixture is calcined in a rotary kiln under the conditions of temperature 950° C./7 hours (first calcination). The obtained calcination product is ground in a wet ball mill for 7 hours into an average particle size of 2.0 μm, followed by granulation in a spray dryer. The obtained particles are calcined in a rotary kiln under the conditions of temperature 950° C./6 hours (second calcination). The obtained calcination product is ground in a wet ball mill for 3 hours into an average particle size of 5.6 μm, followed by granulation in a spray dryer. The obtained particles are fired under the conditions of temperature 1,300° C./5 hours in an electric furnace. The obtained fired product is subjected to disintegration and classification to provide ferrite core particles (2) having a volume-average particle size of 32 μm.

Preparation of Resin Layer-Forming Solution (1)

Cyclohexyl methacrylate/methyl methacrylate copolymer (CHMA, copolymerization ratio 95 mol:5 mol): 3 parts Toluene: 14 parts These materials and glass beads (diameter 1 mm, the same amount as toluene) are placed in a sand mill (available from Kansai Paint Co., Ltd.) and stirred at a rotation speed of 1,200 rpm (revolutions per minute) for 30 minutes to prepare a resin layer-forming solution (1).

Preparation of Filled Core Carrier (4)

Resin-filled core particles (1): 100 parts

Resin layer-forming solution (1): 3 parts (in terms of solids content)

The resin-filled core particles 1 are placed in a vacuum degassing kneader, and the resin layer-forming solution (1) is further placed therein. The mixture is stirred with heating under reduced pressure to distill toluene off, whereby the resin-filled core particles (1) are coated with the resin. Next, fine particles and coarse particles are removed in an Elbow jet to provide a filled core carrier (4).

Preparation of Resin Layer-Forming Solution (2)

Silicone resin (SR-2411 available from Dow Corning Toray Co., Ltd., resin solids content 20 mass %): 3 parts by weight in terms of solids content γ-aminopropyltriethoxysilane: 0.15 parts by mass Toluene: 100 parts by mass These materials and glass beads (diameter 1 mm, the same amount as toluene) are placed in a sand mill (available from Kansai Paint Co., Ltd.) and stirred at a rotation speed of 1,200 rpm for 30 minutes to prepare a resin layer-forming solution (2).

Preparation of Two-Layer-Coated Ferrite Carrier (1)

In a Nauta mixer, 100 parts by mass of the ferrite core particles (2) are placed, and 1.0 part by mass (in terms of resin component) of the resin layer-forming solution (2) is further placed therein. The mixture is heated to a temperature of 70° C. under reduced pressure and mixed at 100 rpm to cause solvent removal and coating over 2 hours. The obtained sample is left to stand and fired at 200° C. in an electric furnace for 1 hour. The obtained sample is placed in the Nauta mixer again, and 1.0 part by mass of the resin layer-forming solution (1) is further placed therein. The mixture is heated to a temperature of 70° C. under reduced pressure and mixed at 100 rpm to cause solvent removal and coating over 2 hours. The obtained sample is transferred to a Julia Mixer and heated to a temperature of 100° C. in a nitrogen atmosphere for 2 hours. The sample is classified through a screen with a mesh size of 70 μm to provide a carrier (1).

Preparation of Two-Layer-Coated Ferrite Carrier (2)

The same process as for the carrier (1) is carried out except that a sample obtained by coating with 2.0 parts by mass of the resin layer-forming solution (2) and performing firing in the electric furnace is placed in the Nauta mixer again, and 2.0 parts by mass of the resin layer-forming solution (1) is further added for coating. The sample is classified through a screen with a mesh size of 70 μm to provide a carrier 2.

Preparation of Two-Layer-Coated Ferrite Carrier (3)

The same process as for the carrier (1) is carried out except that a sample obtained by coating with 0.75 parts by mass of the resin layer-forming solution (2) and performing firing in the electric furnace is placed in the Nauta mixer again, and 0.75 parts by mass of the resin layer-forming solution (1) is further added for coating. The sample is classified through a screen with a mesh size of 70 μm to provide a carrier 3.

Preparation of Two-Layer-Coated Ferrite Carrier (5)

The same process as for the carrier (1) is carried out except that a sample obtained by coating with 1.0 part by mass of the resin layer-forming solution (2) and performing firing in the electric furnace is placed in the Nauta mixer again, and 1.0 part by mass of the resin layer-forming solution (1) is further added for coating. The sample is classified through a screen with a mesh size of 70 μm to provide a carrier 5.

Preparation of Two-Layer-Coated Ferrite Carrier (6)

The same process as for the carrier (1) is carried out except that a sample obtained by coating with 0.75 parts by mass of the resin layer-forming solution (2) and performing firing in the electric furnace is placed in the Nauta mixer again, 0.75 parts by mass of the resin layer-forming solution (1) is further placed therein, and the mixture is mixed at 150 rpm to cause solvent removal and coating over 4 hours. The sample is classified through a screen with a mesh size of 70 μm to provide a carrier 6.

Preparation of Single-Layer-Coated Ferrite Carrier (7)

In the Nauta mixer, 100 parts by mass of the ferrite core particles (2) are placed, and 2.0 parts by mass of the resin layer-forming solution (1) is further placed. The mixture is heated to a temperature of 70° C. under reduced pressure and mixed at 100 rpm to cause solvent removal and coating over 2 hours. The obtained sample is transferred to a Julia Mixer and heated to a temperature of 100° C. in a nitrogen atmosphere for 2 hours. The sample is classified through a screen with a mesh size of 70 μm to provide a carrier (7).

Determination of Percentage of Silicone Resin Exposed on Surface of Carrier

The area ratio of Si element is calculated as the amount of the exposed silicone resin as follows: detecting the ratio of C, O, Fe, Mn, Mg, and Si elements on the surface of the carrier by using an X-ray photoelectron spectrometer (XPS, JPS-9000MX available from JEOL Ltd.); and determining the ratio of the peak from Si element.

Preparation of Strontium Titanate ($SrTiO_3$) Particles (1)

Metatitanic acid (0.7 mol in terms of $TiO_2$), which is a titanium source obtained after desulfurization and deflocculation, is collected and placed in a reactor. Next, 0.77 mol of a strontium chloride aqueous solution is added to the reactor such that the molar ratio of $SrO/TiO_2$ is 1.1. Next, to the reactor, a solution of lanthanum oxide in nitric acid is added in an amount of 2.5 mol (in terms of lanthanum) per 100 mol of strontium. The initial $TiO_2$ concentration in a mixture of three materials is 0.75 mol/L. Next, the mixture is stirred and heated to 90° C. While the mixture is maintained at 90° C. under stirring, 153 mL of a 10N (mol/L) aqueous sodium hydroxide solution is added over 4 hours. While being further maintained at 90° C., the mixture is continuously stirred for 1 hour. Next, the reaction liquid is cooled to 40° C., and hydrochloric acid is added until pH 5.5. The reaction liquid is stirred for 1 hour. Next, the precipitate is washed by repeating decantation and redispersion in water. A slurry containing the washed precipitate is adjusted to pH 6.5 by addition of hydrochloric acid, and the solid matter is filtered out and dried. To 100 parts of the dried solid matter, a solution of i-butyltrimethoxysilane (i-BTMS) in ethanol is added in an amount of 20 parts (in terms of i-BTMS) per 100 parts of the solid matter. The mixture is stirred for 1 hour. The solid matter is filtered out and dried in an atmosphere at 130° C. for 7 hours to provide strontium titanate particles (1).

Preparation of Strontium Titanate Particles (2)

Strontium titanate particles (2) are prepared in the same manner as in the preparation of the strontium titanate particles (1) except that the time over which a 10N aqueous sodium hydroxide solution is added dropwise is changed to 1 hour, and the stirring time is changed to 45 minutes.

Preparation of Strontium Titanate Particles (3)

Strontium titanate particles (3) are prepared in the same manner as in the preparation of the strontium titanate particles (1) except that the time over which a 10N aqueous sodium hydroxide solution is added dropwise is changed to 14.5 hours, and the stirring time is changed to 2 hours.

Preparation of Strontium Titanate Particles (4)

Strontium titanate particles (4) are prepared in the same manner as in the preparation of the strontium titanate particles (1) except that the time over which a 10 N aqueous sodium hydroxide solution is added dropwise is changed to 0.5 hours, and the stirring time is changed to 40 minutes.

Preparation of Strontium Titanate Particles (5)

Strontium titanate particles (5) are prepared in the same manner as in the preparation of the strontium titanate particles (1) except that the time over which a 10N aqueous sodium hydroxide solution is added dropwise is changed to 20.0 hours, and the stirring time is changed to 2 hours.

Preparation of Resin Particle Dispersion (1)

- Ethylene glycol (available from Wako Pure Chemical Industries, Ltd.): 37 parts
- Neopentyl glycol (available from Wako Pure Chemical Industries, Ltd.): 65 parts
- 1,9-Nonanediol (available from Wako Pure Chemical Industries, Ltd.): 32 parts
- Terephthalic acid (available from Wako Pure Chemical Industries, Ltd.): 96 parts These materials are placed in a flask and heated to a temperature of 200° C. over 1 hour. After the reaction system is confirmed to be uniformly stirred, 1.2 parts of dibutyltin oxide is added. While generated water is distilled off, the mixture is heated to a temperature of 240° C. over 6 hours and continuously stirred at 240° C. for 4 hours to provide a polyester resin (acid value 9.4 mgKOH/g, weight-average molecular weight 13,000, glass transition temperature 62° C.). The polyester resin in the melted state is transferred to an emulsifying and dispersing machine (Cavitron CD1010, Eurotech Co., Ltd.) at a rate of 100 g/m. Separately, a dilute aqueous ammonia solution (concentration 0.370) obtained by diluting a reagent grade aqueous ammonia solution with ion exchange water is placed in a tank. While being heated to 120° C. with a heat exchanger, the dilute aqueous ammonia solution is transferred to the emulsifying and dispersing machine at a rate of 0.1 L/min simultaneously with the polyester resin. The emulsifying and dispersing machine operates at a rotor rotation speed of 60 Hz and a pressure of 5 kg/cm$^2$ to prepare a resin particle dispersion (1) with a volume-average particle size of 160 nm and a solids content of 30%.

Preparation of Resin Particle Dispersion (2)

Decanedioic acid (available from Tokyo Chemical Industry Co., Ltd.): 81 parts

Hexanediol (available from Wako Pure Chemical Industries, Ltd.): 47 parts

These materials are placed in a flask and heated to a temperature of 160° C. over 1 hour. After the reaction system is confirmed to be uniformly stirred, 0.03 parts of dibutyltin oxide is added. While generated water is distilled off, the mixture is heated to a temperature of 200° C. over 6 hours and continuously stirred at 200° C. for 4 hours. Next, the reaction liquid is cooled and subjected to solid-liquid separation. The solid matter is dried at a temperature of 40° C. under reduced pressure to provide a polyester resin (C1) (melting point 64° C., weight-average molecular weight 15,000).

Polyester resin (C1): 50 parts

Anionic surfactant (Neogen SC available from DKS Co. Ltd.): 2 parts

Ion exchange water: 200 parts

These material are heated to 120° C., dispersed well with a homogenizer (Ultra-Turrax T50 available from IKA Ltd.), and dispersed with a pressure discharge homogenizer. When the volume-average particle size reaches 180 nm, the dispersion is collected to provide a resin particle dispersion (2) having a solids content of 20%. Preparation of Coloring Agent Particle Dispersion (1)

Cyan pigment (Pigment Blue 15:3 available from Dainichiseika Color & Chemicals Mfg. Co., Ltd.): 10 parts Anionic surfactant (available from Neogen SC, DKS Co. Ltd.): 2 parts Ion exchange water: 80 parts These materials are mixed and dispersed with a high-pressure impact disperser (Ultimizer HJP30006 available from Sugino Machine Limited) for 1 hour to provide a coloring agent particle dispersion (1) with a volume-average particle size of 180 nm and a solids content of 20%.

Preparation of Release Agent Particle Dispersion (1)

Paraffin wax (HNP-9 available from Nippon Seiro Co., Ltd.): 50 parts

Anionic surfactant (available from Neogen SC, DKS Co. Ltd.): 2 parts

Ion exchange water: 200 parts

These material are heated to 120° C., dispersed well with a homogenizer (Ultra-Turrax T50 available from IKA Ltd.), and dispersed with a pressure discharge homogenizer. When the volume-average particle size reaches 200 nm, the resulting dispersion is collected to provide a release agent particle dispersion (1) having a solids content of 20%. Preparation of Toner (1)

Resin particle dispersion (1): 150 parts

Resin particle dispersion (2): 50 parts

Coloring agent particle dispersion (1): 25 parts

Release agent particle dispersion (1): 35 parts

Polyaluminum chloride: 0.4 parts

Ion exchange water: 100 parts

These materials are placed in a round stainless steel flask and mixed and dispersed well with a homogenizer (Ultra-Turrax T50 available from IKA Ltd.). While being stirred in the flask, the dispersion is then heated to 48° C. in a heating oil bath. The reaction system is maintained at 48° C. for 60 minutes, and then 70 parts of the resin particle dispersion (1) is added slowly. Next, the pH is adjusted to 8.0 with a 0.5 mol/L aqueous sodium hydroxide solution. The flask is sealed, and sealing at the stirring shaft is achieved by magnetic sealing. While being continuously stirred, the mixture is heated to 90° C. and maintained for 30 minutes. Next, the mixture is cooled at a cooling rate of 5° C./min, subjected to solid-liquid separation, and washed well with ion exchange water. Next, the obtained material is washed by solid-liquid separation, redispersion in ion exchange water at 30° C., and stirring at a rotation speed of 300 rpm for 15 minutes. This washing process is repeated another 6 times. When the pH of the filtrate reaches 7.54 and the electrical conductivity of the filtrate reaches 6.5 μS/cm, the mixture is subjected to solid-liquid separation, and vacuum drying continues for 24 hours to provide toner particles (1) having a volume-average particle size of 5.7 μm.

To 100 parts by mass of the toner particles (1), 1.0 part by mass of RX 50 (available from Nippon Aerosil Co., Ltd.), and 1.0 part by mass of the strontium titanate particles (1) are added and mixed in a Henschel mixer (FM-75 model available from Nippon Coke & Engineering Co., Ltd.) at a number of rotation of 30 s$^{-1}$ for a rotation time of 15 minutes to provide a mixture. The obtained mixture is heated to provide a heated toner (toner (1)). The operation conditions are as follows: feed rate=5 kg/hr; hot air temperature C=220° C.; hot air flow rate=6 m$^3$/min; cool air temperature E=5° C.; cool air flow rate=4 m$^3$/min; cool air absolute water content=3 g/m$^3$; blower flow rate=20 m$^3$/min; and injection air flow rate=1 m$^3$/min.

Preparation of Toner (2)

A toner (2) is prepared by the same method as for the toner (1) except that 0.5 parts by mass of the strontium titanate particles (1) are added.

Preparation of Toner (3)

A toner (3) is prepared by the same method as for the toner (1) except that 2.0 parts by mass of the strontium titanate particles (1) are added.

Preparation of Toner (4)

A toner (4) is prepared by the same method as for the toner (1) except that 0.25 parts by mass of the strontium titanate particles (1) are added.

Preparation of Toner (5)

A toner (5) is prepared by the same method as for the toner (1) except that 2.5 parts by mass of the strontium titanate particles (1) are added.

Preparation of Toner (7)

A toner (7) is prepared by the same method as for the toner (1) except that 1.0 part by mass of the strontium titanate particles (4) are added.

Preparation of Toner (8)

A toner (8) is prepared by the same method as for the toner (1) except that 1.0 part by mass of the strontium titanate particles (5) are added.

Preparation of Binder Resin 1

In a 4-L, four-necked glass flask, 80 parts by mass of polyoxypropylene-(2.2)-2,2-bis(4-hydroxyphenyl)propane, 25 parts by mass of terephthalic acid, and 0.5 parts by mass of titanium tetrabutoxide are placed. A thermometer, a stirring rod, a capacitor, and a nitrogen inlet tube are attached to the flask, and the flask is placed in a mantle heater. Next, the flask is purged with nitrogen gas, and the mixture is then slowly heated under stirring and stirred at a temperature of 200° C. to cause reaction for 4 hours. Subsequently, 2.0 parts by mass of trimellitic anhydride is added to cause reaction at 180° C. for 2 hours and thus to provide a binder resin 1.

Preparation of Binder Resin 2

In a 4-L, four-necked glass flask, 70 parts by mass of polyoxypropylene-(2.2)-2,2-bis(4-hydroxyphenyl)propane, 25 parts by mass of terephthalic acid, and 0.6 parts by mass of titanium tetrabutoxide are placed. A thermometer, a stirring rod, a capacitor, and a nitrogen inlet tube are attached to the flask, and the flask is placed in a mantle heater. Next, the flask is purged with nitrogen gas, and the mixture is then slowly heated under stirring and stirred at a temperature of 200° C. to cause reaction for 3 hours. Subsequently, 7 parts by mass of trimellitic anhydride is added to cause reaction at 180° C. for 8 hours and thus to provide a binder resin 2.

Preparation of Toner (6)

Binder resin 1: 60.0 parts by mass

Binder resin 2: 60.0 parts by mass

Fischer-Tropsch wax (differential scanning calorimetry (DSC) maximum endothermic peak 76° C.): 7.0 parts by mass C.I. Pigment blue 15:3: 4.5 parts by mass Aluminum 3,5-di-t-butylsalicylate compound: 0.5 parts by mass These materials are mixed with a Henschel mixer (FM-75 model available from Nippon Coke & Engineering Co., Ltd.) at a number of rotation of 20 $s^{-1}$ for a rotation time of 15 minutes to provide a toner composition. Next, the toner composition is kneaded in a twin-screw kneader (PCM-30 model available from Ikegai Corporation) set at a temperature of 140° C. to provide a melt-kneaded product. The obtained kneaded product is cooled, roughly crushed into 1 mm or less with a hammer mill, and next finely ground in a mechanical grinding machine (T-250 available from Turbo Kogyo Co., Ltd.) to provide a ground product.

To 100 parts by mass of the obtained ground product, 1.0 part by mass of RX 50 (available from Nippon Aerosil Co., Ltd.,) and 1.0 part by mass of the strontium titanate particles (1) are externally added by the same method as in the preparation of the toner (1) to provide a toner (6).

Example 1

Preparation of Electrostatic Charge Image Developer

In a V-blender, 100 parts of the carrier (1) and 7 parts of the toner (1) are placed and stirred for 20 minutes. The mixture is screened through a screen with a mesh size of 212 μm to provide a developer.

Examples 2 to 11 and Comparative Examples 1 to 5

Preparation of Electrostatic Charge Image Developer

Each developer described in Table is produced similarly to Example 1.

Various Types of Analysis

Shape Characteristics of Strontium Titanate Particles

The toner is imaged at a magnification of 40,000 times under a scanning electron microscope (SEM, S-4800 available from Hitachi High-Technologies Corporation) equipped with an energy dispersive X-ray (EDX) spectrometer (EMAX Evolution X-Max 80 $mm^2$ available from Horiba Ltd.). The EDX analysis specifies 300 or more primary particles of strontium titanate in one field of view on the basis of the presence of Ti and Sr. The toner is observed under the SEM at an acceleration voltage of 15 kV, an emission current of 20 μA, and a WD of 15 mm. The EDX analysis is carried out for a detection time of 60 minutes under the same conditions.

The specified strontium titanate particles are analyzed using imaging analysis software WinRoof (available from MITANI Corporation) to obtain the equivalent circle diameter, the area, and the circumference of each primary particle image and to further obtain circularity=$4\pi\times$(area)/(circumference)$^2$. The equivalent circle diameter at cumulative 50% from the smaller particle size side in the equivalent circle diameter distribution is referred to as an average primary particle size. The circularity at cumulative 50% from the smaller circularity side in the circularity distribution is referred to as an average circularity. The circularity at cumulative 84% from the smaller circularity side in the circularity distribution is referred to as a circularity at cumulative 84%. The standard deviation is also obtained from the circularity distribution.

The obtained values are summarized in Table 1.

X-ray Diffraction of Strontium Titanate Particles

The strontium titanate particles before externally added to toner particles are used as a sample and analyzed for its crystal structure by using X-ray diffraction analysis under the above-described conditions.

Any of the strontium titanate particles shows a peak corresponding to the peak from the (110) plane of the perovskite crystal at a diffraction angle 2θ of about 32°, and the width at half maximum of each peak is in the range of 0.2° or more and 0.5° or less.

Average Circularity of Toner Particles

The toner particles before external addition of external additives are analyzed with a flow-type particle image analyzer (FPIA-3000 available from Sysmex Corporation) to determine the circularity=(the circumference of a circle having the same area as the projected particle image)/(the circumference of the projected particle image). The circularity at cumulative 50% from the smaller circularity side in the circularity distribution of 3,000 toner particles is referred to as the average circularity of the toner particles.

When the toner particles have external additives, the foregoing measurements are carried out after external additives with a relatively large particle size (e.g., external additives with a primary particle size of 100 nm or more) are removed. The external additives are removed as described below.

In a 200 mL glass bottle, 40 mL of a 0.2 mass6 Triton X-100 aqueous solution (available from Acros Organics) and 2 g of a toner are placed and stirred 500 times to form a dispersion. Next, while the dispersion is maintained at 20° C.±0.5° C., ultrasonic waves are applied to the dispersion by using an ultrasonic homogenizer (US-300AT available from Nippon Seiki Co., Ltd.). The application of ultrasonic waves are performed under the following conditions: application time: 300 seconds continuously; output: 75 W; amplitude: 180 μm; and distance between ultrasonic vibrator and container bottom surface: 10 mm. Next, the dispersion is centrifuged in a compact, high-speed centrifuge (refrigeration) (M201-IVD available from Sakuma) at 3,000 rpm at a cooling temperature of 0° C. for 2 minutes. The supernatant is removed, and the residual slurry is filtered through filter paper (qualitative filter paper No. 5C, 110 nm, available from Advantec Toyo Kaisha, Ltd.). The residue on the filter paper is washed with ion exchange water twice and dried to provide a test sample.

Evaluation

Evaluation of Initial Density Unevenness and Fogging

In an environment at 22.5° C. and 50% RH, an image sample in which rectangular patches having an image density of 1% are drawn is continuously outputted on 500 sheets of A4 size plain paper (paper C2 available from Fuji Xerox Co., Ltd.) using a modified machine of DocuCentre Color 400 (available from Fuji Xerox Co., Ltd.) in the test. After the test, the environment is changed to an environment at 28° C. and 90% RH. In the first operation in the morning on the next day, the Imaging Society of Japan test chart No. 5-1 is outputted and evaluated for its image quality.

Fogging Evaluation

The following items are graded based on visual and sensory evaluation: the dirt in non-image areas when the Imaging Society of Japan test chart No. 5-1 is outputted on five sheets in the first operation in the morning on the next day after the environment is changed to an environment at 28° C. and 90% RH after continuous printing; and the dirt in the machine after printing.

A: No dirt is observed in non-image areas of the image, and the image quality is acceptable.

B: Toner scattering is observed in the machine, but the image quality is acceptable.

C: Minor dirt is observed in non-image areas of the image.

D: Obvious dirt is observed in non-image areas of the image.

Density Unevenness Evaluation

The Imaging Society of Japan test chart No. 5-1 is outputted on five sheets, and the density of the patch part of the solid image is measured. ΔE is calculated as described below.

$$\Delta E = (\text{maximum image density among five sheets}) - (\text{minimum image density among five sheets})$$

The image density ($=(L^{*2}+a^{*2}+b^{*2})^{0.5}$) is measured with an image density measuring device X-RITE 938 (available from X-RITE, Incorporated).

A: The density variation ΔE in the image is less than 0.3 and not visually observed. The image quality is acceptable.

B: The density variation ΔE in the image is 0.3 or more and 0.5 or less, and there is minor unevenness. It is an acceptable level in terms of image quality.

C: The density variation ΔE in the image is 0.5 or more and 1.0 or less, and minor unevenness is observed.

D: The density variation ΔE in the image is over 1.0, and obvious density unevenness is observed in the image.

Evaluation of Density Unevenness Over Time

In an environment at 22.5° C. and 50% RH, an image sample in which rectangular patches having an image density of 1% are drawn is continuously outputted on 100,000 sheets of A4 size plain paper (paper C2 available from Fuji Xerox Co., Ltd.) using a modified machine of DocuCentre Color 400 (available from Fuji Xerox Co., Ltd.) over 10 days in the test. After the image sample is outputted on total 100,000 sheets, the environment is changed to an environment at 28° C. and 90% RH. In the first operation in the morning on the next day, the Imaging Society of Japan test chart No. 5 is then outputted and evaluated for its image quality.

TABLE 1

| | Carrier | | | | | Toner | | Strontium Titanate Particles | | |
|---|---|---|---|---|---|---|---|---|---|---|
| | category | core | resin in lower layer or in core | upper layer | C(c) (area %) | category | C(t) (area %) | category | average primary particle size (nm) | average circularity |
| Example 1 | (1) | ferrite core | silicone resin | CHMA | 1 | (1) | 20 | (1) | 53 | 0.925 |
| Example 2 | (1) | ferrite core | silicone resin | CHMA | 1 | (2) | 10 | (1) | 53 | 0.925 |
| Example 3 | (1) | ferrite core | silicone resin | CHMA | 1 | (3) | 40 | (1) | 53 | 0.925 |
| Example 4 | (2) | ferrite core | silicone resin | CHMA | 0.5 | (1) | 20 | (1) | 53 | 0.925 |
| Example 5 | (3) | ferrite core | silicone resin | CHMA | 20 | (1) | 20 | (1) | 53 | 0.925 |
| Example 6 | (4) | ferrite core | silicone resin | CHMA | 1 | (1) | 20 | (1) | 53 | 0.925 |
| Example 7 | (1) | ferrite core | silicone resin | CHMA | 1 | (1) | 20 | (2) | 25 | 0.938 |
| Example 8 | (1) | ferrite core | silicone resin | CHMA | 1 | (1) | 20 | (3) | 94 | 0.856 |
| Example 9 | (1) | ferrite core | silicone resin | CHMA | 1 | (4) | 5 | (1) | 53 | 0.925 |
| Example 10 | (1) | ferrite core | silicone resin | CHMA | 1 | (5) | 50 | (1) | 53 | 0.925 |
| Example 11 | (1) | ferrite core | silicone resin | CHMA | 1 | (6) | 20 | (1) | 53 | 0.925 |
| Comparative Example 1 | (5) | ferrite core | silicone resin | CHMA | 0.1 | (1) | 20 | (1) | 53 | 0.925 |
| Comparative Example 2 | (6) | ferrite core | silicone resin | CHMA | 30 | (1) | 20 | (1) | 53 | 0.925 |
| Comparative Example 3 | (7) | ferrite core | none | CHMA | 1 | (1) | 20 | (1) | 53 | 0.925 |
| Comparative Example 4 | (1) | ferrite core | silicone resin | CHMA | 1 | (7) | 20 | (4) | 19 | 0.941 |
| Comparative Example 5 | (1) | ferrite core | silicone resin | CHMA | 1 | (8) | 20 | (5) | 105 | 0.841 |

| | Strontium Titanate Particles | | | | Evaluation | | |
|---|---|---|---|---|---|---|---|
| | circularity at cumulative 84% | width (°) at half maximum of peak from (110) plane | content (mass %) | Developer C(t)/C(c) | fogging | initial density unevenness | density unevenness over time |
| Example 1 | 0.952 | 0.32 | 1.0 | 20 | A | A | A |
| Example 2 | 0.952 | 0.32 | 0.5 | 10 | B | B | B |
| Example 3 | 0.952 | 0.32 | 2.0 | 40 | B | B | B |
| Example 4 | 0.952 | 0.32 | 1.0 | 40 | A | B | A |
| Example 5 | 0.952 | 0.32 | 1.0 | 1 | C | A | B |

TABLE 1-continued

| | | | | | | | |
|---|---|---|---|---|---|---|---|
| Example 6 | 0.952 | 0.32 | 1.0 | 20 | A | A | A |
| Example 7 | 0.973 | 0.82 | 1.0 | 20 | C | B | B |
| Example 8 | 0.924 | 0.24 | 1.0 | 20 | C | B | B |
| Example 9 | 0.952 | 0.32 | 0.25 | 5 | B | C | C |
| Example 10 | 0.952 | 0.32 | 2.5 | 50 | B | C | C |
| Example 11 | 0.952 | 0.32 | 1.0 | 20 | A | A | B |
| Comparative Example 1 | 0.952 | 0.32 | 1.0 | 200 | B | D | D |
| Comparative Example 2 | 0.952 | 0.32 | 1.0 | 0.67 | D | C | D |
| Comparative Example 3 | 0.952 | 0.32 | 1.0 | 20 | B | D | C |
| Comparative Example 4 | 0.98 | 0.88 | 1.0 | 20 | C | D | D |
| Comparative Example 5 | 0.918 | 0.20 | 1.0 | 20 | C | D | D |

The results in Table 1 indicate that the electrostatic charge image developers of Examples reduce occurrence of density unevenness in the initial printing stage even after being left to stand in a high-temperature, high-humidity environment compared with the electrostatic charge image developers of Comparative Examples.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrostatic charge image developer comprising:

a carrier including a core and, on the core, a silicone resin-containing layer serving as a lower layer, and an acrylic resin-containing layer serving as an upper layer, or a carrier including a silicone resin-containing core and an acrylic resin-containing layer on the silicone resin-containing core;

strontium titanate particles having an average primary particle size of 20 nm or more and 100 nm or less; and a toner, wherein a percentage of a silicone resin exposed on a surface of the carrier is 0.5 area % or more and 20 area % or less.

2. The electrostatic charge image developer according to claim 1, wherein an amount of the strontium titanate particles is 10 area % or more and 40 area % or less in terms of coverage of the toner.

3. The electrostatic charge image developer according to claim 2, wherein a ratio C(t)/C(c) of the amount C(t) (area %) of the strontium titanate particles in terms of coverage of the toner to the percentage C(c) (area %) of the silicone resin exposed on the surface of the carrier is more than 0.5 and 45 or less.

4. The electrostatic charge image developer according to claim 1, wherein an amount of the strontium titanate particles other than the strontium titanate particles being free and the strontium titanate particles firmly adhering to the toner is 10 mass % or more and 70 mass % or less relative to a total mass of the strontium titanate particles.

5. The electrostatic charge image developer according to claim 1, wherein a ratio Da/Ra of the average primary particle size Da (nm) of the strontium titanate particles to a surface roughness Ra (μm) of the carrier is 3 or more and 45 or less.

6. The electrostatic charge image developer according to claim 1, wherein a surface roughness Ra of the carrier is 0.3 μm or more and 0.9 μm or less.

7. The electrostatic charge image developer according to claim 1, wherein an average circularity of primary particles of the strontium titanate particles is 0.82 or more and 0.94 or less.

8. The electrostatic charge image developer according to claim 1, wherein a circularity of primary particles of the strontium titanate particles at cumulative 84% is more than 0.92.

9. The electrostatic charge image developer according to claim 1, wherein a width at half maximum of a peak from a (110) plane in X-ray diffraction analysis of the strontium titanate particles is 0.2° or more and 2.0° or less.

10. The electrostatic charge image developer according to claim 1, wherein the strontium titanate particles contain La or Si as a dopant.

11. The electrostatic charge image developer according to claim 10, wherein the strontium titanate particles contain La as a dopant.

12. The electrostatic charge image developer according to claim 1, wherein the strontium titanate particles have an average primary particle size of 30 nm or more and 80 nm or less.

13. The electrostatic charge image developer according to claim 12, wherein the strontium titanate particles have an average primary particle size of 30 nm or more and 60 nm or less.

14. The electrostatic charge image developer according to claim 1, wherein the acrylic resin-containing layer has an average thickness of 0.1 μm or more and 5 μm or less, and the silicone resin-containing layer has a larger average thickness than the acrylic resin-containing layer.

15. The electrostatic charge image developer according to claim 1, wherein the electrostatic charge image developer comprises the carrier including a silicone resin-containing core and an acrylic resin-containing layer on the silicone resin-containing core.

16. A process cartridge comprising a developing unit that contains the electrostatic charge image developer according to claim 1 and develops an electrostatic charge image on a surface of an image holding body by using the electrostatic charge image developer to form a toner image, wherein the process cartridge is attachable to and detachable from an image forming apparatus.

* * * * *